US011376862B2

(12) United States Patent
Przybyla et al.

(10) Patent No.: US 11,376,862 B2
(45) Date of Patent: Jul. 5, 2022

(54) FLUID EJECTION WITH MICROPUMPS AND PRESSURE-DIFFERENCE BASED FLUID FLOW

(71) Applicant: HEWLETT-PACKARD DEVELOPMENT COMPANY, L.P., Spring, TX (US)

(72) Inventors: James R. Przybyla, Corvallis, OR (US); Jordan E. Morris, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/603,570

(22) PCT Filed: Jul. 23, 2018

(86) PCT No.: PCT/US2018/043223

§ 371 (c)(1),
(2) Date: Oct. 7, 2019

(87) PCT Pub. No.: WO2020/023002

PCT Pub. Date: Jan. 30, 2020

(65) Prior Publication Data

US 2021/0362508 A1 Nov. 25, 2021

(51) Int. Cl.
*B41J 2/14* (2006.01)
*B41J 2/175* (2006.01)

(52) U.S. Cl.
CPC ..... *B41J 2/17596* (2013.01); *B41J 2/14314* (2013.01); *B41J 2002/14306* (2013.01)

(58) Field of Classification Search
CPC ..... B41J 2/17596; B41J 2/14314; B41J 2002/14306; B41J 2/17503; B41J 2/17563; B41J 2/17566; B41J 2/17593; B41J 2/18
See application file for complete search history.

(56) References Cited

U.S. PATENT DOCUMENTS

| | | | |
|---|---|---|---|
| 5,764,258 | A | 6/1998 | Hetzer et al. |
| 7,328,981 | B2 | 2/2008 | Kuroda |
| 9,266,323 | B2 | 2/2016 | Reinten |
| 2004/0202554 | A1 | 10/2004 | Takeuchi et al. |
| 2005/0104941 | A1 | 5/2005 | Tanaka |

(Continued)

FOREIGN PATENT DOCUMENTS

| | | |
|---|---|---|
| CN | 107521234 A | 12/2017 |
| JP | 58-187369 | 11/1983 |

(Continued)

*Primary Examiner* — Kristal Feggins
(74) *Attorney, Agent, or Firm* — Fabian VanCott

(57) ABSTRACT

The fluid ejection device includes a plurality of nozzles and a plurality of ejection chambers that includes a respective ejection chamber fluidically coupled to a respective nozzle. A plurality of inlet passages are fluidically coupled to the ejection chambers and input fluid to the ejection chambers at a first pressure. A plurality of outlet passages are fluidically coupled to the ejection chambers and output fluid from the ejection chambers at a second pressure that is less than the first pressure. Fluid circulates through the ejection chambers based on the pressure difference between the first and second pressure. The fluid ejection device also includes at least one micropump fluidically coupled to at least one ejection chamber to pump fluid through the at least one ejection chamber.

20 Claims, 21 Drawing Sheets

(56) References Cited

U.S. PATENT DOCUMENTS

| | | | |
|---|---|---|---|
| 2013/0155135 | A1 | 6/2013 | Govyadinov et al. |
| 2013/0182022 | A1 | 7/2013 | Strunk et al. |
| 2014/0078224 | A1 | 3/2014 | Park et al. |
| 2017/0151807 | A1 | 6/2017 | Govyadinov et al. |
| 2017/0313063 | A1 | 11/2017 | Govyadinov et al. |

FOREIGN PATENT DOCUMENTS

| | | | |
|---|---|---|---|
| JP | 2001-121719 | A | 5/2001 |
| JP | 2018-103418 | A | 7/2018 |
| WO | WO2017074427 | A1 | 5/2017 |
| WO | 2018/084826 | A1 | 5/2018 |

FLUID EJECTION WITH MICROPUMPS AND PRESSURE-DIFFERENCE BASED FLUID FLOW

BACKGROUND

A fluid ejection device is a component of a fluid ejection system that ejects fluid. A fluid ejection device includes a number of fluid ejecting nozzles. Through these nozzles, fluid, such as ink and fusing agent among others, is ejected. An ejection chamber holds an amount of fluid to be ejected and a fluid actuator within the ejection chamber operates to eject the fluid through the nozzle.

BRIEF DESCRIPTION OF THE DRAWINGS

The accompanying drawings illustrate various examples of the principles described herein and are part of the specification. The illustrated examples are given merely for illustration, and do not limit the scope of the claims.

DETAILED DESCRIPTION

Figure 1A:
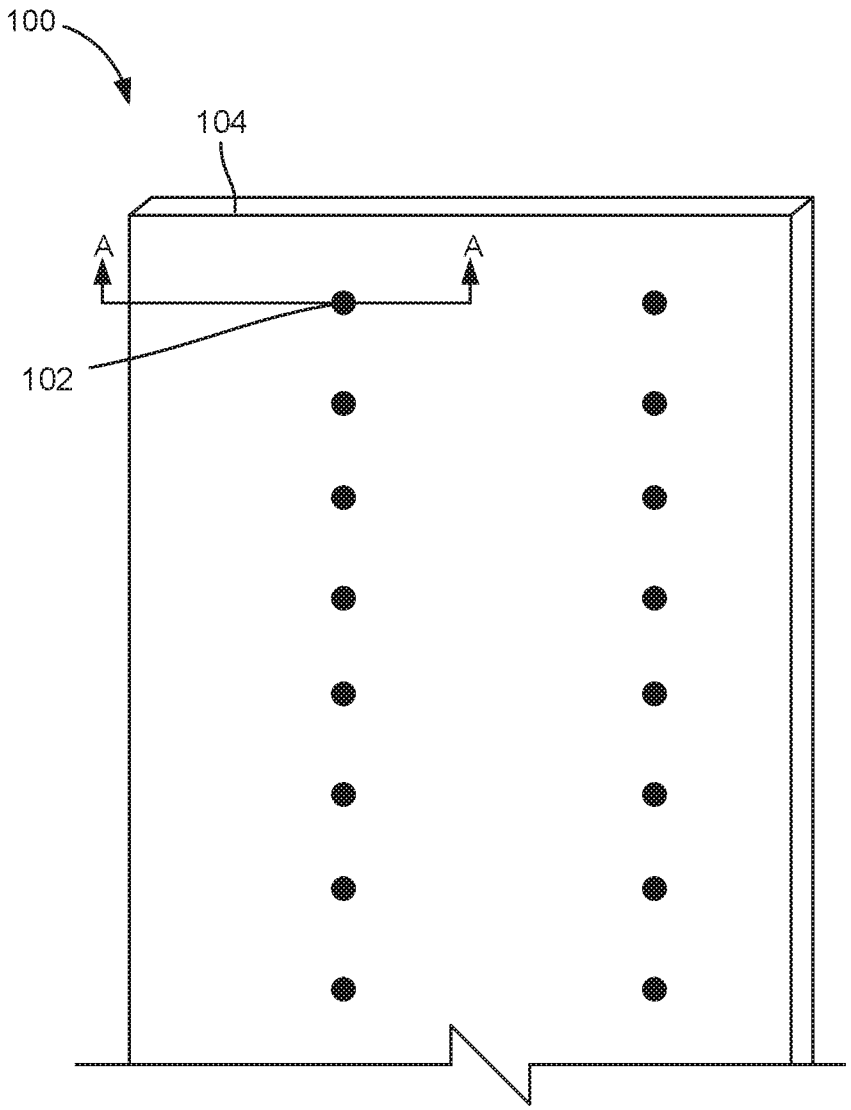
FIGS. 1A and 1B are diagrams of a fluid ejection device with micropumps and pressure-difference based fluid flow, according to an example of the principles described herein.

Fluid ejection devices, as used herein, may describe a variety of types of integrated devices with which small volumes of fluid may be ejected. In a specific example, these fluid ejection devices are found in any number of printing devices such as inkjet printers, multi-function printers (MFPs), and additive manufacturing apparatuses. The fluidic systems in these devices are used for precisely, and rapidly, dispensing small quantities of fluid. For example, in an additive manufacturing apparatus, the fluid ejection system dispenses fusing agent. The fusing agent is deposited on a build material, which fusing agent facilitates the hardening of build material to form a three-dimensional product.

Other fluid ejection systems dispense ink on a two-dimensional print medium such as paper. For example, during inkjet printing, fluid is directed to a fluid ejection device. Depending on the content to be printed, the system in which the fluid ejection devices is disposed determines the time and position at which the ink drops are to be released/ejected onto the print medium. In this way, the fluid ejection device releases multiple ink drops over a predefined area to produce a representation of the image content to be printed. Besides paper, other forms of print media may also be used. Accordingly, as has been described, the devices and methods described herein may be implemented in two-dimensional printing, i.e., depositing fluid on a substrate, and in three-dimensional printing, i.e., depositing a fusing agent or other functional agent on a material base to form a three-dimensional printed product.

As will be appreciated, examples provided herein may be formed by performing various microfabrication and/or micromachining processes on at least one substrate to form and/or connect structures and/or components. The substrate may comprise a silicon based wafer or other such similar materials used for microfabricated devices (e.g., glass, gallium arsenide, metals, ceramics, plastics, etc.). Examples may comprise microfluidic channels, fluid actuators, nozzles, volumetric chambers, or any combination thereof. Microfluidic channels and/or chambers may be formed by performing etching, microfabrication (e.g., photolithography), micromachining processes, or any combination thereof in a substrate. Accordingly, microfluidic channels and/or chambers may be defined by surfaces fabricated in the substrate of a microfluidic device. As used herein, a microfluidic channel or a microfluidic chamber may be so described because such channels and chambers may facilitate storage and conveyance of volumes of fluid in the nanoliter scale, picoliter scale, microliter scale, etc.

Examples provided herein may implement fluid actuators, where such fluid actuators may comprise thermal actuators, piezo-membrane actuators, electrostatic actuators, mechanical/impact driven membrane actuators, magnetostrictive drive actuators, electrochemical actuators, other such microdevices, or any combination thereof. In some examples, a fluid actuator may be disposed in a microfluidic volume, such as a channel or chamber. Actuation of the fluid actuator may cause displacement of fluid proximate the fluid actuator, and such fluid displacement, in turn, may result in flow of fluid in the microfluidic volume. Accordingly, such example fluid actuators disposed in microfluidic volumes to cause fluid flow therein may be referred to as "micropumps." In some examples, a fluid actuator may be disposed in a microfluidic chamber fluidically coupled to a nozzle through which fluid drops may be ejected. In these examples, actuation of the fluid actuator may cause displacement of fluid proximate the fluid actuator such that a fluid drop may be ejected via the nozzle. Accordingly, such example fluid actuators disposed in ejection chambers fluidically coupled to nozzles may be referred to as "fluid ejectors."

While such fluidic ejection devices have increased in efficiency in ejecting various types of fluid, enhancements to their operation can yield increased performance. As one example, the operation of some ejectors may alter the composition of the fluid passing through the ejection chamber. For example, a thermal ejector heats up in response to an applied voltage. As the thermal ejector heats up, a portion of the fluid in an ejection chamber vaporizes to form a bubble. This bubble pushes fluid out the nozzle and onto the print medium. When the ejector is not firing, portions of the fluid evaporate through the nozzle such that the fluid becomes depleted of water or other volatile solvents. In other words, the fluid becomes more concentrated and more viscous. Fluid that is depleted of water can negatively influence the nozzles and can result in reduced fluid quality.

This is partly addressed by circulating the fluid passing to the nozzle and/or to the chamber. However, the desirable impact of recirculating mechanisms is reduced due to fluid mechanics. For example, fluid is supplied to the fluid ejection device die via a fluid supply system. A fluid supply system may include fluid supply components, such as pumps, regulators, tanks, and other such components that apply fluid pressure differentials to the fluid supply system and fluid ejection devices connected thereto to thereby drive fluid through these fluid supply components and fluid ejection devices connected thereto. In some fluid ejection systems, fluidic aspects of fluid ejection devices implemented therein may limit the effects of this fluid flow in the chambers and the fluid passages of the fluid ejection devices.

Accordingly, the present specification describes a fluid ejection device that solves these and other issues. Specifically, the present specification describes a fluid ejection device and method that force flow through an ejection chamber via a pressure differential. The fluid ejection devices may also adjust fluid flow through ejection chambers with at least one micropump located proximate to and fluidically connected with the ejection chambers. In these examples, the fluid ejection device includes inlet passages and outlet passages that are fluidically coupled to channels on the back of the fluid ejection device having different fluid pressures.

Such a flow generated by a pressure differential cools the fluid ejection device which may be heated by actuating thermal ejectors and ensures uniformly printed fluid, and provides fresh fluid to the nozzle. However, pressure differentials by themselves may vary across different nozzles due to pressure drops caused by different path lengths, geometries, etc. Moreover, if the pressure differential is too great, excessive flow rates may result, which can lead to changes in composition of the fluid, i.e. solvent depletion. Still further, by always providing fresh fluid to the nozzle, the evaporation rate of solvents can increase, which as noted above can cause a change in the composition of the fluid, resulting in a decreased print quality. Moreover, such pressure differential flow is applied across multiple nozzles. Such a bulk operation therefore operates on all nozzles the same, regardless of differences between the nozzles.

Accordingly, examples provided herein further include at least one micropump to facilitate device-level and/or chamber-level control of fluid flow through to thereby increase the operating efficiency of a fluid ejection system. Specifically, a micropump allows for programmatically applying an actuation pulse to individual micropumps. Local heating can also be somewhat mitigated by actuating micropumps just before ejecting drops with a given fluid ejector.

Accordingly, the present specification describes a hybrid system for facilitating fluid flow through an ejection chamber, which fluid flow enables through-chamber circulation of fluid driven at least in part by system-level pressure differentials and at least in part by micropump actuation. In some examples, such through-chamber circulation of fluid may be referred to as micro-recirculation. In particular, for a fluid ejection device, such as a printhead or printhead module, fluid is circulated through each ejection chamber of the fluid ejection device at least in part by supplying and collecting the fluid at pressure differentials. For example, fluid supplied to manifolds, channels, and ultimately ejection chambers may be driven at a first pressure, and collection of fluid from the chambers, channels, and manifolds may be driven at a second pressure that is less than the first pressure. In one specific example, the fluid supply may be driven at a positive pressure, and the fluid collection may be driven by a vacuum. In another example, the fluid pressure of the fluid collection may be less such that fluid from the supply is driven into the fluid collection path.

Furthermore, the fluid flow through the ejection chamber may be selectively adjusted by actuation of a micropump that is proximate to, and fluidically connected to, the ejection chamber. For example, while pressure differentials may generate a flow through an ejection chamber at a particular rate, F1, the flow rate may be temporarily adjusted to a different value, F2, via actuation of the micropump. In some examples, actuation of the micropump may increase the flow rate. That is, actuation of the micropump may increase the pressure differential between the inlet and the outlet of the ejection chamber. In other examples, actuation of the micropump may decrease the flow rate. That is, actuation of the micropump may reduce the pressure differential between the inlet and the outlet of the ejection chamber. Thus a customized flow may be generated through an ejection chamber based on the selective activation, and placement, of such micropumps throughout the fluid ejection device. Such a customized flow rate facilitates customization of the operation of the fluid ejection device based on system and fluid characteristics Accordingly, differential pressures can be augmented or reduced by micropumps to tailor the flow to ejection chambers and/or nozzles as desired to compensate for pressure non-uniformities caused by geometry effects. The placement of the ejector relative to the nozzle can be chosen to augment flow in low flow regions (by placing the pump upstream of the ejector) and/or decrease the flow in high flow regions (by placing the pump downstream of the ejector). The temperature increase due to pump firing can be mitigated by the cooling effect of the differential pressure method. In such examples, positioning of a micropump relative to the ejection chamber may correspond to whether actuation of the micropump increases or decreases a flow rate of fluid through the chamber. For example, in a thermal actuator-based micropump, if the micropump is positioned on the inlet passage side of the ejection chamber, actuation of the micropump may increase a flow rate of fluid through the ejection chamber. Conversely, if the micropump is positioned on the outlet passage side of the ejection chamber, actuation of the micropump may decrease a flow rate of fluid through the ejection chamber. In another example, in a membrane-based actuator micropump, deflection of the membrane into the microvolume or away from the microvolume may cause different flow characteristics.

Specifically, the present specification describes a fluid ejection device. The fluid ejection device includes a plurality of nozzles and a plurality of ejection chambers. The plurality of ejection chambers includes a respective ejection chamber which is fluidically coupled to a respective nozzle of the plurality of nozzles. The fluid ejection device also includes a plurality of inlet passages. The inlet passages are fluidically coupled to the ejection chambers and input fluid to the ejection chambers at a first pressure. The fluid ejection device also includes a plurality of outlet passages. The plurality of outlet passages are fluidically coupled to the ejection chambers and outputs fluid from the ejection chamber at a second pressure that is less than the first pressure. Accordingly fluid circulates through the ejection chambers based on the pressure difference between the first pressure and the second pressure. The fluid ejection device also includes at least one micropump fluidically coupled to at least one ejection chamber to pump fluid through the at least one ejection chamber.

In another example, the fluid ejection device includes a plurality of nozzles and a plurality of ejection chambers. The plurality of ejection chambers includes a respective ejection chamber which is fluidically coupled to a respective nozzle of the plurality of nozzles. The fluid ejection device also includes a plurality of inlet passages which includes a respective inlet passage fluidically coupled to the respective ejection chamber. The fluid ejection device also includes a plurality of outlet passages which includes a respective outlet passage fluidically coupled to the respective ejection chamber. In this example, the fluid ejection device includes at least one input channel. The at least one input channel 1) is fluidically coupled to at least a subset of inlet passages of the plurality of inlet passages and 2) supplies fluid to the subset of inlet passages at a first pressure. The fluid ejection device also includes at least one output channel. The at least one output channel 1) is fluidically coupled to at least a subset of outlet passages of the plurality of outlet passages and 2) receives fluid from the subset of outlet passages at a second pressure different than the first pressure to facilitate fluid circulation through respective ejection chambers fluidically coupled to the subset of inlet passages and the subset of outlet passages. The fluid ejection device also includes at least one micropump fluidically coupled to at least one ejection chamber to pump fluid through the at least one ejection chamber.

The present specification also describes a method. According to the method, fluid is circulated through a plurality of ejection chambers at a first flow rate by 1) supplying fluid to the plurality of ejection chambers at a first pressure and 2) collecting fluid from the plurality of ejection chambers at a second pressure that is lower than the first pressure. The circulation of fluid is selectively adjusted through the plurality of ejection chambers to a second flow rate by actuating at least one micropump fluidically coupled to the plurality of ejection chambers.

Figure 1B:
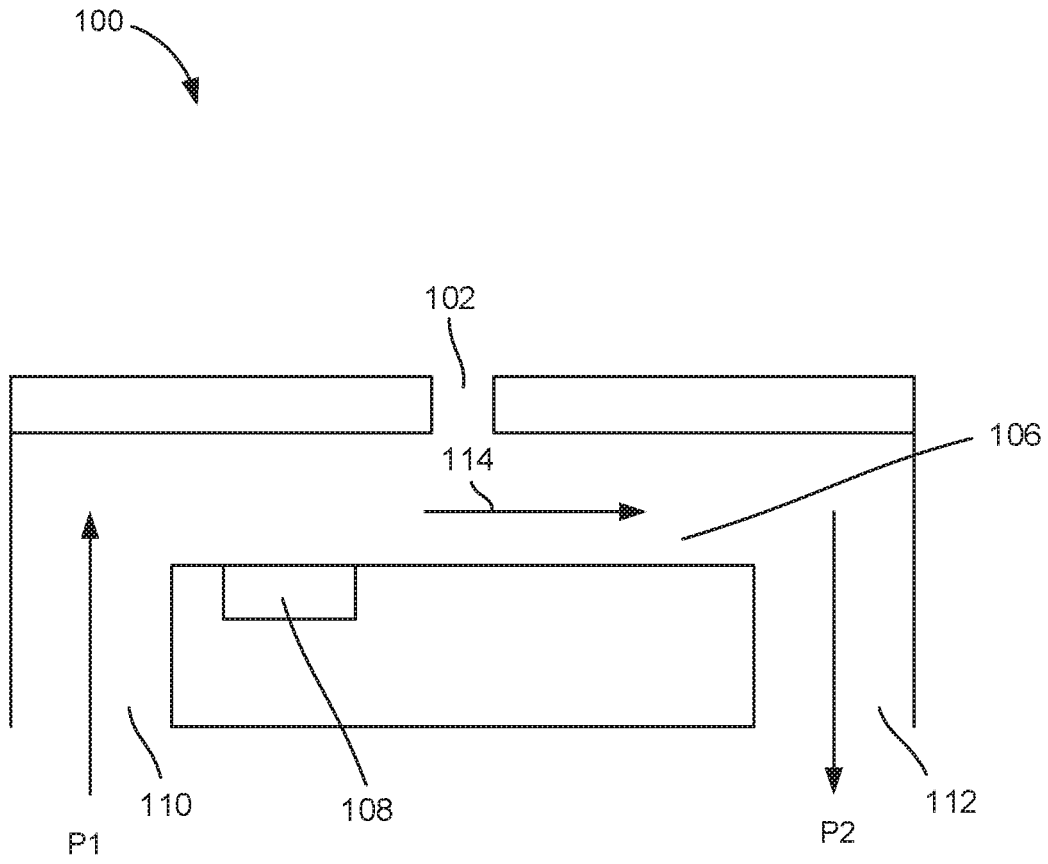

Turning now to the figures, FIGS. 1A and 1B are diagrams of a fluid ejection device (100) with micropumps (108) and pressure-difference based fluid flow, according to an example of the principles described herein. Specifically, FIG. 1A is an isometric view and FIG. 1B is a cross-sectional view taken along the line A-A from FIG. 1A. As described above, the fluid ejection device (100) refers to a component of a fluid ejection system used in depositing fluids onto a substrate. To carry out such fluid ejection, the fluid ejection device (100) includes a variety of components. For example, the fluid ejection device (100) includes a plurality of nozzles (102). Fluid is expelled by the fluid ejection device (100) through the nozzles (102). For simplicity in FIG. 1A, one nozzle (102) has been indicated with a reference number. Moreover, it should be noted that the relative size of the nozzles (102) and the fluid ejection device (100) are not to scale, with the nozzles (102) being enlarged for purposes of illustration.

The nozzles (102) of the fluid ejection device (100) may be arranged in columns or arrays such that properly sequenced ejection of fluid from the nozzles (102) causes characters, symbols, and/or other graphics or images to be printed on the print medium as the fluid ejection device (100) and print medium are moved relative to each other.

The fluid ejection device (100) may be coupled to a controller that controls the fluid ejection device (100) in ejecting fluid from the nozzles (102). For example, the controller defines a pattern of ejected fluid drops that form characters, symbols, and/or other graphics or images on the print medium. The pattern of ejected fluid drops is determined by the print job commands and/or command parameters received from a computing device.

The fluid ejection device (100) may be formed of various layers. For example, a nozzle substrate (104) may define the ejection chambers and nozzles (102). The nozzle substrate (104) may be formed of SU-8 or other material. Other layers of the fluid ejection device (100) may be formed of other layers.

Turning now to FIG. 1B, the fluid ejection device (100) also includes a plurality of ejection chambers (106). The ejection chambers (106) hold an amount of fluid to be ejected through the nozzle (102). Accordingly, a respective ejection chamber (106) of the plurality is fluidically coupled to a respective nozzle (102) of the plurality. As described above, the ejection chamber (106) and nozzle (102) may be defined in a nozzle substrate (104) formed of a material such as SU-8.

During fluid ejection, fluid is depleted from the ejection chamber (106). Accordingly, the fluid ejection device (100) includes a plurality of inlet passages (110) and a plurality of outlet passage (112). An inlet passage (110) is fluidically coupled to an ejection chamber (106) and supplies fluid to the ejection chamber (106). An outlet passage (112) is also fluidically coupled to the ejection chamber (106) and collects fluid from the ejection chamber (106). In some examples, the inlet fluid pressure is different than the outlet fluid pressure. For example, the inlet passage (110) may supply fluid to the ejection chamber (106) at a first pressure, P1 and the outlet passage (112) may collect fluid from the ejection chamber (106) at a second pressure, P2. The second pressure, P2, may be less than the first pressure, P1, such that a pressure differential exists. Such pressures may be generated by respective regulators coupled to the inlet passage (110) and the outlet passage (112).

This pressure differential generates a flow (114) through the ejection chamber (106). Such a flow (114) facilitates the replenishment of fluid through the ejection chamber (106) and also facilitates the expulsion of unused fluid from the ejection chamber (106). Thus, a recirculation loop is generated.

In some examples, the passages (110, 112) and ejection chamber (106) may be micro-fluidic structures. In this example, the micro-fluidic passages (110, 112) and micro-fluidic ejection chamber (106) form a micro-recirculation loop. A micro-fluidic structure may be of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Such micro-structures prevent sedimentation of the fluid passing there through and ensures that fresh fluid is available within the ejection chamber (106).

In some cases, it may be desirable to adjust the rate of flow through the ejection chamber (106). Accordingly, the fluid ejection device (100) includes at least one micropump (108). A micropump (108) is fluidically coupled to the ejection chamber (106) to pump fluid through the ejection chamber (106). In some examples, as depicted in FIG. 1B, the micropump (108) may be disposed within the ejection chamber (106), but in other examples as depicted below, the micropump (108) may be disposed at different locations within the fluid ejection device (100). As will be described in the following figures, the micropump (108) may include a firing resistor or other thermal device, a piezoelectric element, or other mechanism for ejecting fluid from the ejection chamber (106).

Accordingly, such a fluid ejection device provides pressure-difference based flow which may cool the fluid ejection device (100) components and can ensure print uniformity. Moreover, by including a micropump (108), individual flow rates can be generated at each nozzle (102). Moreover, the addition of the micropump (108) provides another tool to increase or decrease the flow rate through an ejection chamber (106). Thus, increased control of flow rates is provided, which flow rates can be controlled per-nozzle (102), thus enhancing the overall control of the printing operation and quality.

Figure 2:
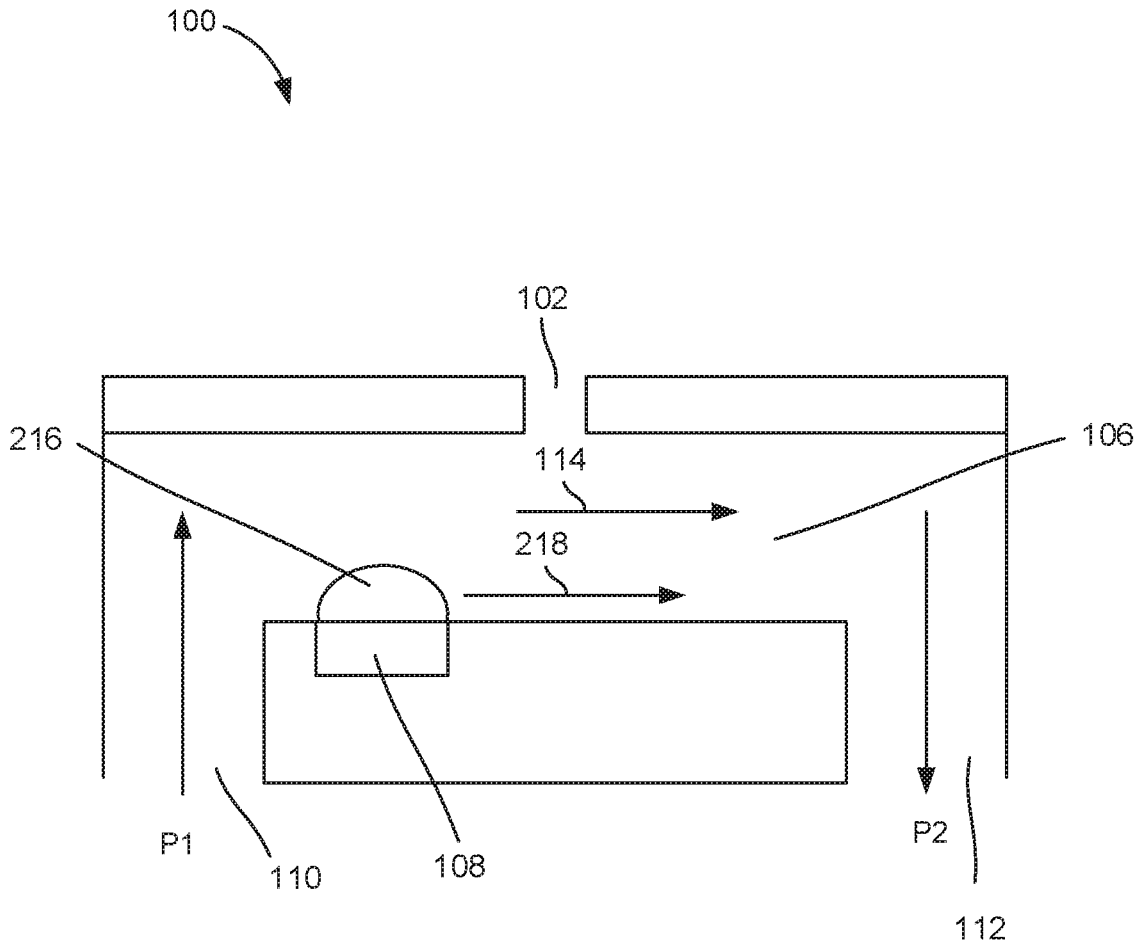
FIG. 2 is a cross-sectional diagram of a fluid ejection device with micropumps and pressure-difference based fluid flow with an upstream micropump, according to an example of the principles described herein.

FIG. 2 is a cross-sectional diagram of a fluid ejection device (100) with micropumps (108) and pressure-difference based fluid flow with an upstream micropump (108), according to an example of the principles described herein. As described above, the fluid micropump (108) may be of varying types. For example, the fluid micropump (108) may be a thermal resistor. The thermal resistor heats up in response to an applied voltage. As the thermal resistor heats up, a portion of the fluid in the ejection chamber (106) vaporizes to form a bubble (216). This bubble (216) pushes fluid towards the inlet passage (110) and the outlet passage (112). The pressure wave generated by the drive bubble (216) dissipates at the inlet passage (110) and the outlet passage (112) due to the large volume of fluid. As the vaporized fluid bubble (216) collapses, fluid is drawn back via capillary forces. The ejection chamber (106) refills with fluid more readily from the nearest plenum creating a net flow. For example in FIG. 2, the net flow will be from P1 towards P2, due to the proximity of the micropump (108) to the inlet passage (110). Thus, the pressure drive recirculation is reinforced.

That is, the location of the micropump (108) may affect whether a flow rate through the ejection chamber (106) increases or decrease. For example, as described above, in cases where the fluid micropump (108) is upstream of a nozzle (102), flow rate increases through the ejection chamber (106). It may be desirable to place the micropump (108) upstream in regions of low flow as compared to other regions on the fluidic ejection device (100). In some examples, different nozzles (102) within a fluid ejection device (100) may have corresponding micropumps (108) disposed at different locations. Accordingly, fluid flow through individual nozzles (102) may be tailored based on different existing characteristics or different desired operating characteristics for each nozzle (102).

Returning to the flow, in this example, the flow (218) resulting from the formation of the vapor bubble (216), augments the pressure differential driven flow (114) resulting from a pressure difference between P1 and P2 to result in a flow through the ejection chamber (106) that is greater than the flow rate based solely on the pressure differential. In this example, the micropump (108) may be referred to as a boost pump.

Figure 3:
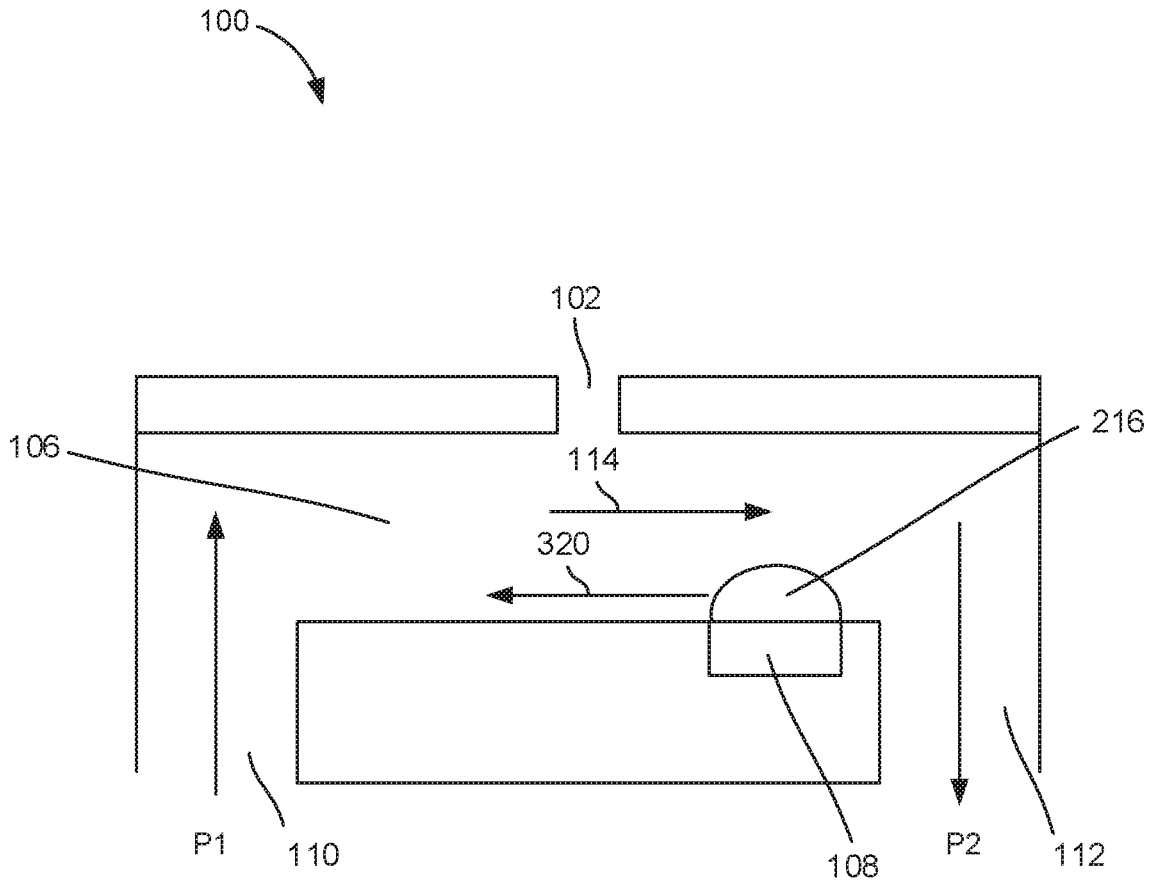
FIG. 3 is a cross-sectional diagram of a fluid ejection device with micropumps and pressure-difference based fluid flow with a downstream pump, according to an example of the principles described herein.

FIG. 3 is a cross-sectional diagram of a fluid ejection device (100) with micropumps (108) and pressure-difference based fluid flow with a downstream micropump (108), according to an example of the principles described herein. As described above, the location of the micropump (108) may affect whether a flow rate through the ejection chamber (106) increases or decreases. In the example, depicted in FIG. 3, the micropump (108) is downstream of a nozzle (102) and decreases a flow rate through the ejection chamber (106). It may be desirable to place the fluid micropump (108) downstream in regions of high flow as compared to other regions on the fluidic ejection device (100).

In this example, the flow (320) resulting from the formation of the vapor bubble (216), counters the pressure differential driven flow (114) resulting from a pressure difference between P1 and P2 to result in a flow through the ejection chamber (106) that is less than the flow rate based solely on the pressure differential.

Figure 4A:
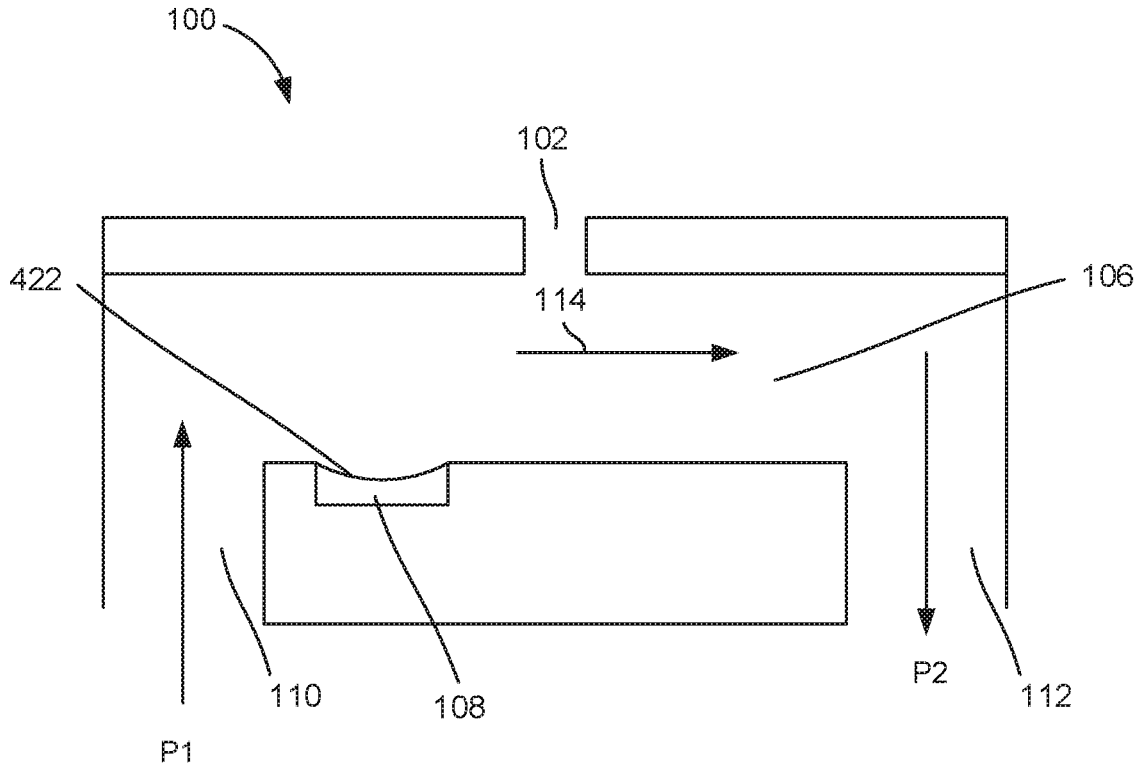
FIGS. 4A and 4B are cross-sectional diagram of a fluid ejection device with micropumps and pressure-difference based fluid circulation with a piezoelectric membrane pump, according to an example of the principles described herein.
Figure 4B:
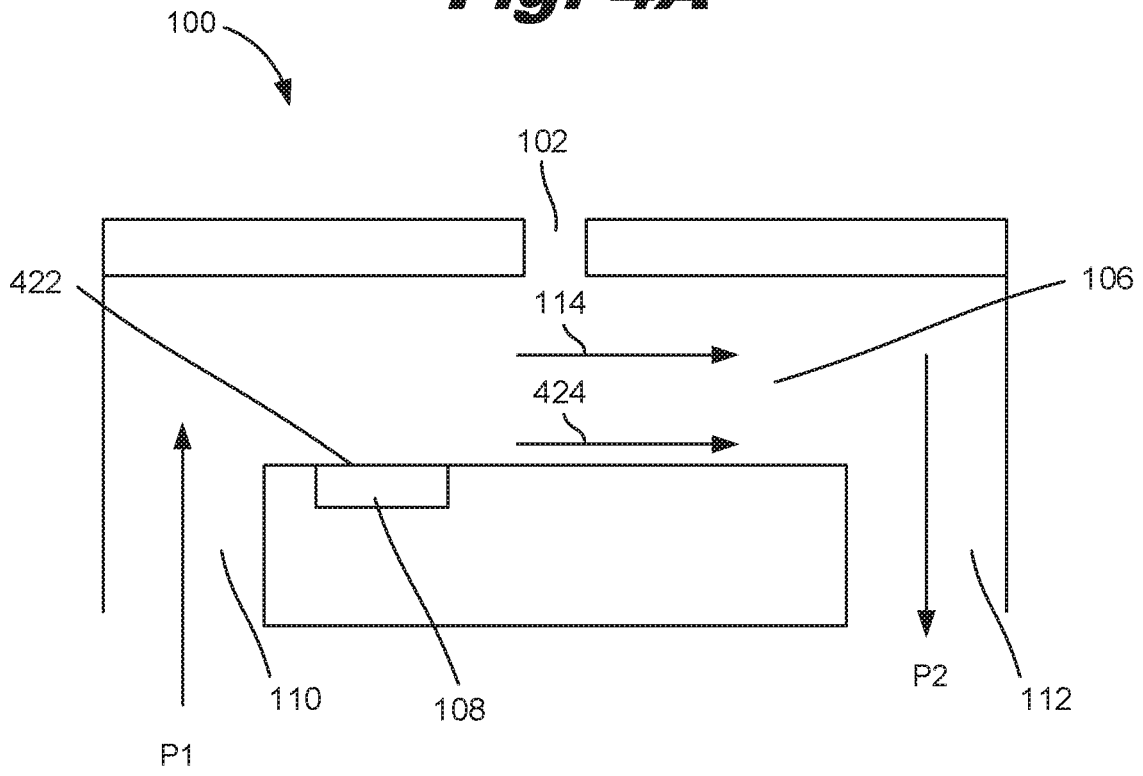

FIGS. 4A and 4B are cross-sectional diagrams of a fluid ejection device (100) with micropumps (108) and pressure-difference based fluid flow with a piezoelectric membrane pump (108), according to an example of the principles described herein. That is, in these examples, the micropump (108) includes a piezoelectric membrane (422). As a voltage is applied, the piezoelectric membrane (422) deflects which generates a pressure pulse in the ejection chamber (106) that causes displacement of fluid which results in a net flow of fluid.

The direction of the net fluid flow resulting from the deflection is based on an initial and secondary state of the piezoelectric membrane (422). For example, as depicted in FIG. 4A, the piezoelectric membrane (422) may have an initially concave position. In this example, a flow (114) resulting from the pressure differential may exist through the ejection chamber (106). An applied voltage causes the piezoelectric membrane (422) to deflect to a flat position as indicated in FIG. 4B. A flow (424) resulting from the deflection of the piezoelectric membrane (422), augments the pressure differential driven flow (114) to result in a flow through the ejection chamber (106) that is greater than the flow rate based solely on the pressure differential.

Figure 5A:
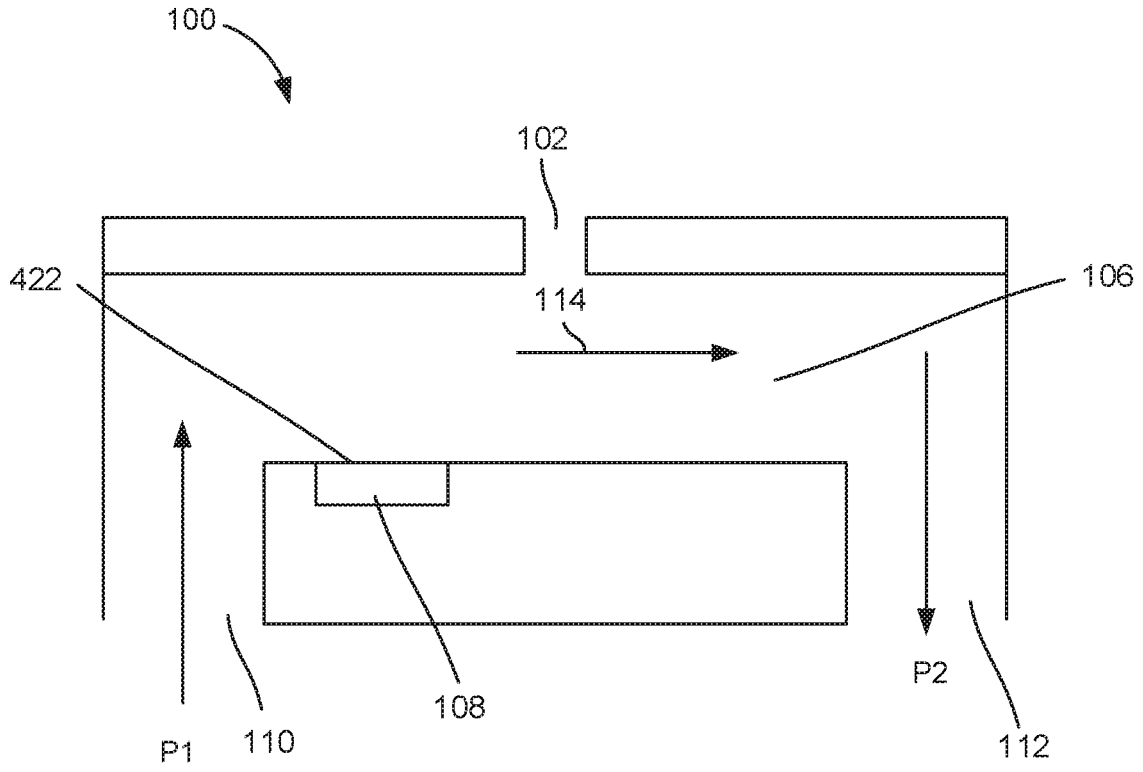
FIGS. 5A and 5B are cross-sectional diagram of a fluid ejection device with micropumps and pressure-difference based fluid circulation with a piezoelectric membrane pump, according to another example of the principles described herein.
Figure 5B:
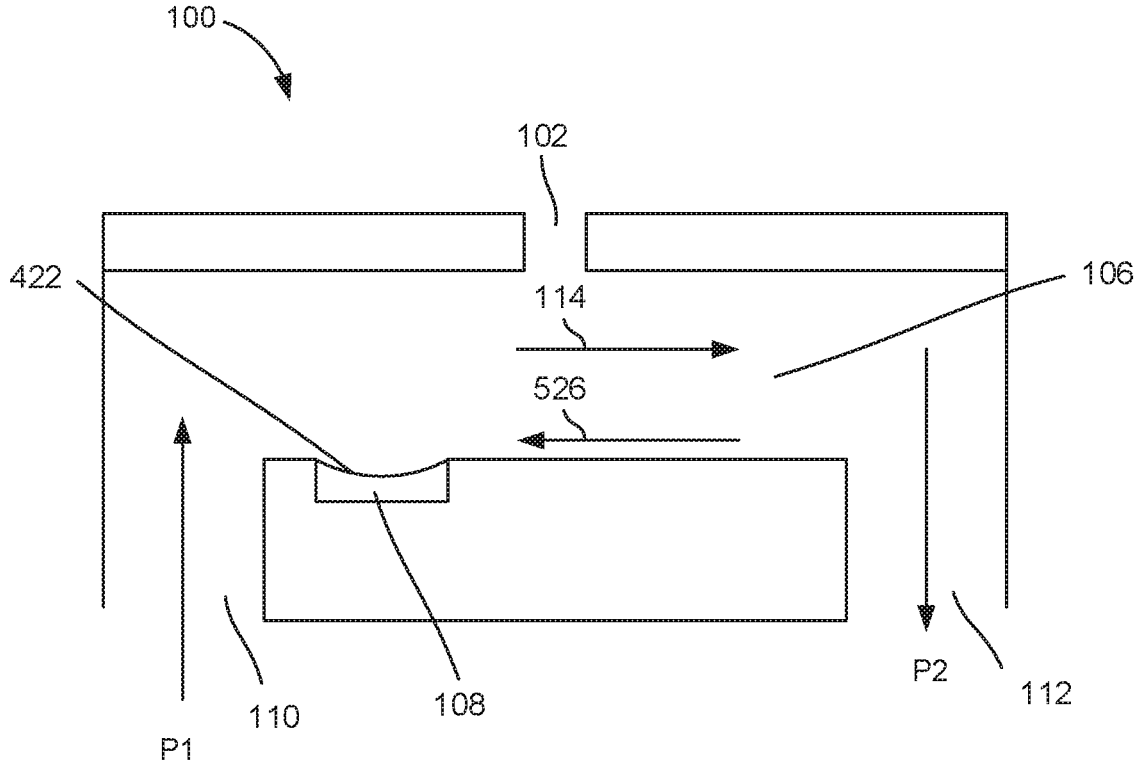

FIGS. 5A and 5B are cross-sectional diagrams of a fluid ejection device (100) with micropumps (108) and pressure-difference based fluid flow with a piezoelectric membrane pump (108), according to an example of the principles described herein. In the example depicted in FIGS. 5A and 5B, the piezoelectric membrane (422) may have an initially flat position as depicted in FIG. 5A. In this example, a flow (114) resulting from the pressure differential may exist through the ejection chamber (106). An applied voltage causes the piezoelectric membrane (422) to deflect to a concave position as indicated in FIG. 5B. A flow (526) resulting from the deflection of the piezoelectric membrane (422) to the concave position, counters the pressure differential driven flow (114) to result in a flow through the ejection chamber (106) that is less than the flow rate based solely on the pressure differential. Note that while FIGS. 4A, 4B, 5A, and 5B depict particular initial and deflected positions, other initial and deflected positions may be implemented in accordance with the principles described herein.

Figure 6:
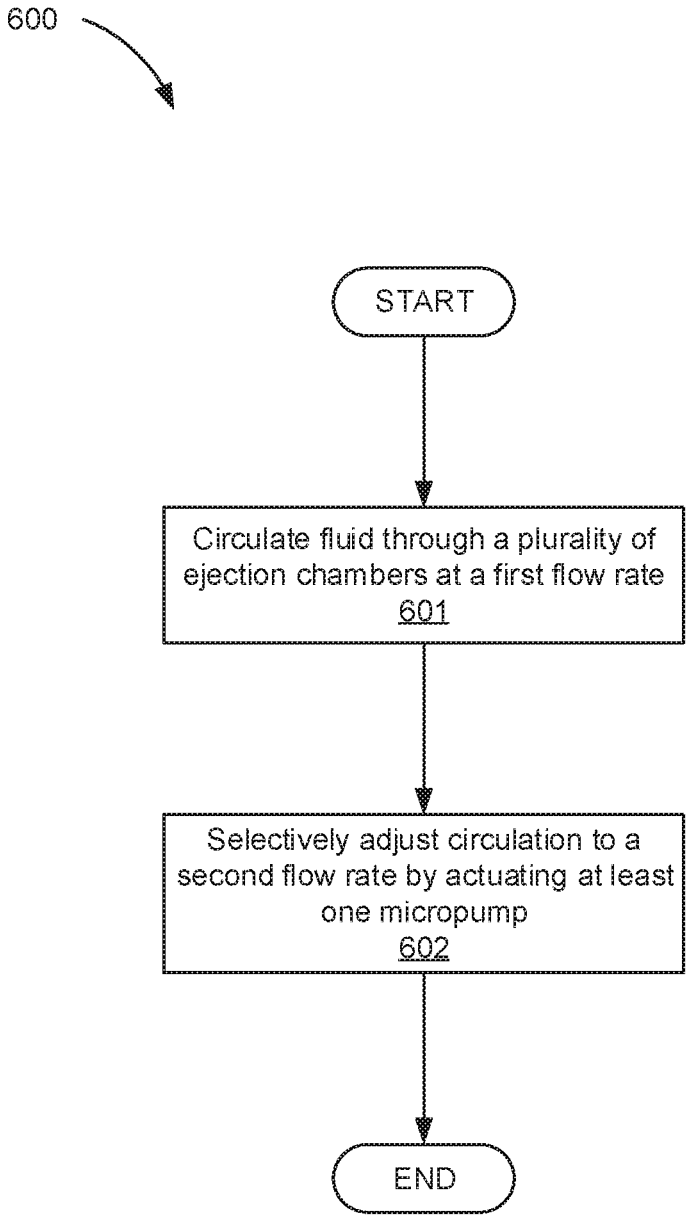
FIG. 6 is a flowchart of a method for fluid ejection with micropumps and pressure-difference based fluid flow, according to an example of the principles described herein.

FIG. 6 is a flowchart of a method (600) for fluid ejection with micropumps (FIG. 1, 108) and pressure-difference based fluid flow, according to an example of the principles described herein. The method (600) as described herein, maintains a pressure differential or gradient across the ejection chambers (FIG. 1B, 106) to circulate fluid across the ejection chambers (FIG. 1B, 106). According to the method (500) fluid, such as ink or additive manufacturing agents, is circulated (block 601) through a plurality of ejection chambers (FIG. 1B, 106). Specifically, the fluid is circulated (block 601) at a first flow rate. The first flow rate may be defined by a pressure differential between inlet passages (FIG. 1B, 110) and outlet passages (FIG. 1B, 112) fluidically coupled to the ejection chamber (FIG. 1B, 106). That is, an inlet passage (FIG. 1B, 110) may be coupled to an input regulator which establishes a first pressure for the incoming fluid. Accordingly, a fluid is supplied to the plurality of ejection chambers (FIG. 1B, 106) at a first pressure. An outlet passage (FIG. 1B, 112) may be coupled to an output regulator which establishes a second fluid pressure for the outgoing fluid. Accordingly, a fluid is collected from the plurality of ejection chambers (FIG. 1B, 106) at a second pressure. The second pressure may be less than the first pressure such that a pressure differential exists, which pressure differential drives fluid from the inlet passage (FIG. 1B, 110) to the outlet passage (FIG. 1B, 112).

In some examples, circulating (block 601) the fluid as described herein may include inputting fluid at the first pressure to input channels that are fluidically coupled to respective ejection chambers (FIG. 1B, 106) and to output the fluid at a second pressure from output channels that are fluidically coupled to respective ejection chambers (FIG. 1B, 106). This may be performed by a pressurized fluid source. Specifically, fluid under pressure is supplied to an inlet passage (FIG. 1B, 110) from a pressurized fluid source that is remote from the fluid ejection device (100). A pressure differential is maintained across the ejection chambers (106) with the fluid supplied by the pressurized fluid source. The pressure differential causes fluid to circulate across the ejection chamber (FIG. 1B, 106) to inhibit particle settling and to transfer heat away from the ejection chamber (FIG. 1B, 106). In one implementation, the pressure differential created across the ejection chamber (FIG. 1B, 106) is at least 0.1 inch we (inches water column).

As described above, for any number of reasons it may be desirable to change the flow rate. For example, an increased flow rate may increase the quality of fluid passed to the nozzle (FIG. 1A, 102) and a decreased flow rate may reduce the effects of excess flow rates, i.e., evaporation, decap, etc. Moreover, changing the flow rate may be done in order to align the flow rates of various nozzles (FIG. 1A, 102) on a fluid ejection device (FIG. 1A, 100).

As such, the method (600) includes selectively adjusting (block 602) circulation within at least one ejection chamber (FIG. 1B, 106). This can be done by actuating at least one micropump (FIG. 1B, 108) fluidically coupled to the plurality of ejection chambers (FIG. 1B, 106). As described above, the positioning as well as initial conditions of the micropump (FIG. 1B, 108) may define how actuation of that micropump (FIG. 1B, 108) alters the net fluid flow through the ejection chambers (FIG. 1B, 106). Accordingly, a wide variety of adjustments are possible based on different circumstances within the fluid ejection device (FIG. 1, 100).

Figure 7:
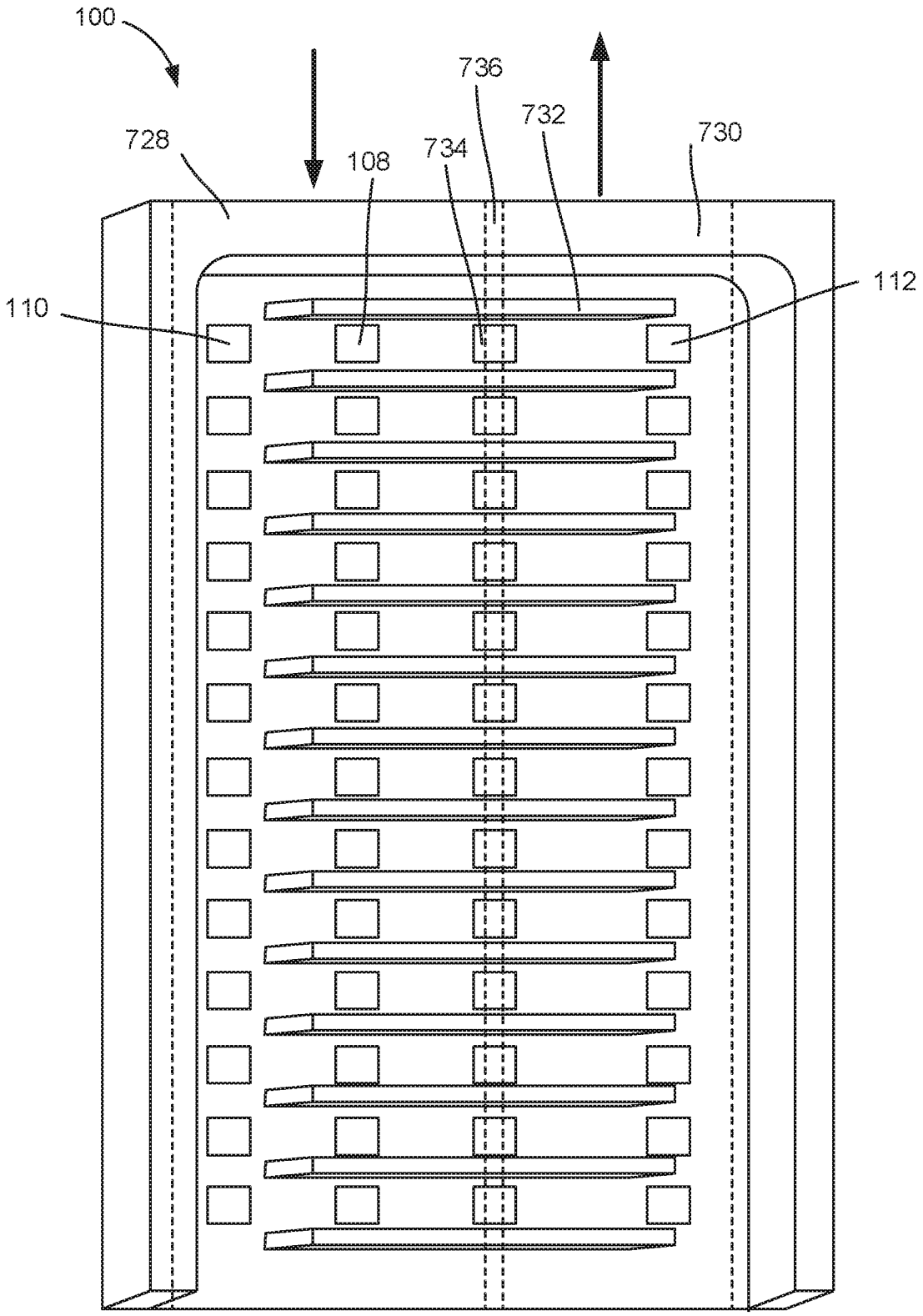
FIG. 7 is an isometric view of a fluid ejection device with micropumps and pressure-difference based fluid flow, according to another example of the principles described herein.

FIG. 7 is an isometric view of a fluid ejection device (100) with micropumps (108) and pressure-difference based fluid flow, according to another example of the principles described herein. Note that in FIG. 7, the layer that includes the nozzles (FIG. 1A, 102) has been removed to expose the underlying components.

In some examples, fluid is passed to the plurality of inlet passages (110) via at least one input channel (728). The at least one input channel (728) is indicated in dashed lines in FIG. 7 indicating its place beneath the layer that forms the inlet passages (110), outlet passages (112) and in which the micropump (108) and ejector (734) are formed. Note that for simplicity, in FIG. 7 a single instance of different components is indicated with a reference number.

Returning to the at least one input channel (728), the at least one input channel (728) is fluidically coupled to at least a subset of inlet passages (110) of the plurality.

In some examples, fluid is passed from the plurality of outlet passages (112) via at least one output channel (730). The at least one fluid output channel (730) is indicated in dashed lines in FIG. 7 indicating its place beneath the layer that forms the inlet passages (110), outlet passages (112) and in which the micropump (108) and ejector (734) are formed. That is, the fluid ejection device (100) includes a channel substrate in which the input channel (728) and output channel (730) are formed. The channel substrate may be formed of silicon.

Returning to the at least one output channel (730), the at least one output channel (730) is fluidically coupled to at least a subset of outlet passages (112) of the plurality. The input channel (728) and output channel (730) are separated from one another by a rib (736) arranged under the ejector (734) and between the inlet passages (110) and the outlet passages (112). Such a rib (736) provides structural rigidity against mechanical and gravitational force existent within the system.

FIG. 7 also depicts an example wherein adjacent ejection chambers (FIG. 1B, 106) are separated by chamber walls (732) to more particularly separate the ejection chambers (FIG. 1B, 106) and generate a more specific and efficient fluid flow.

In this example, fluid flows through the input channel (728) and passes through the various inlet passages (110), it then flows perpendicular across the ejector (734) where it is ejected. Fluid that is not ejected is directed, via differential pressures between the inlet passages (110) and the outlet passages (112) to the output channel (730). That is, as depicted in FIG. 7, the flow between the passages (110, 112) is perpendicular to the flow through the channels (728, 730). While FIG. 7 depicts the micropump (108) between an inlet passage (110) and the ejector (734), in other examples as depicted above, the micropump (108) may be disposed between the ejector (734) and an outlet passage (112).

Figure 8:
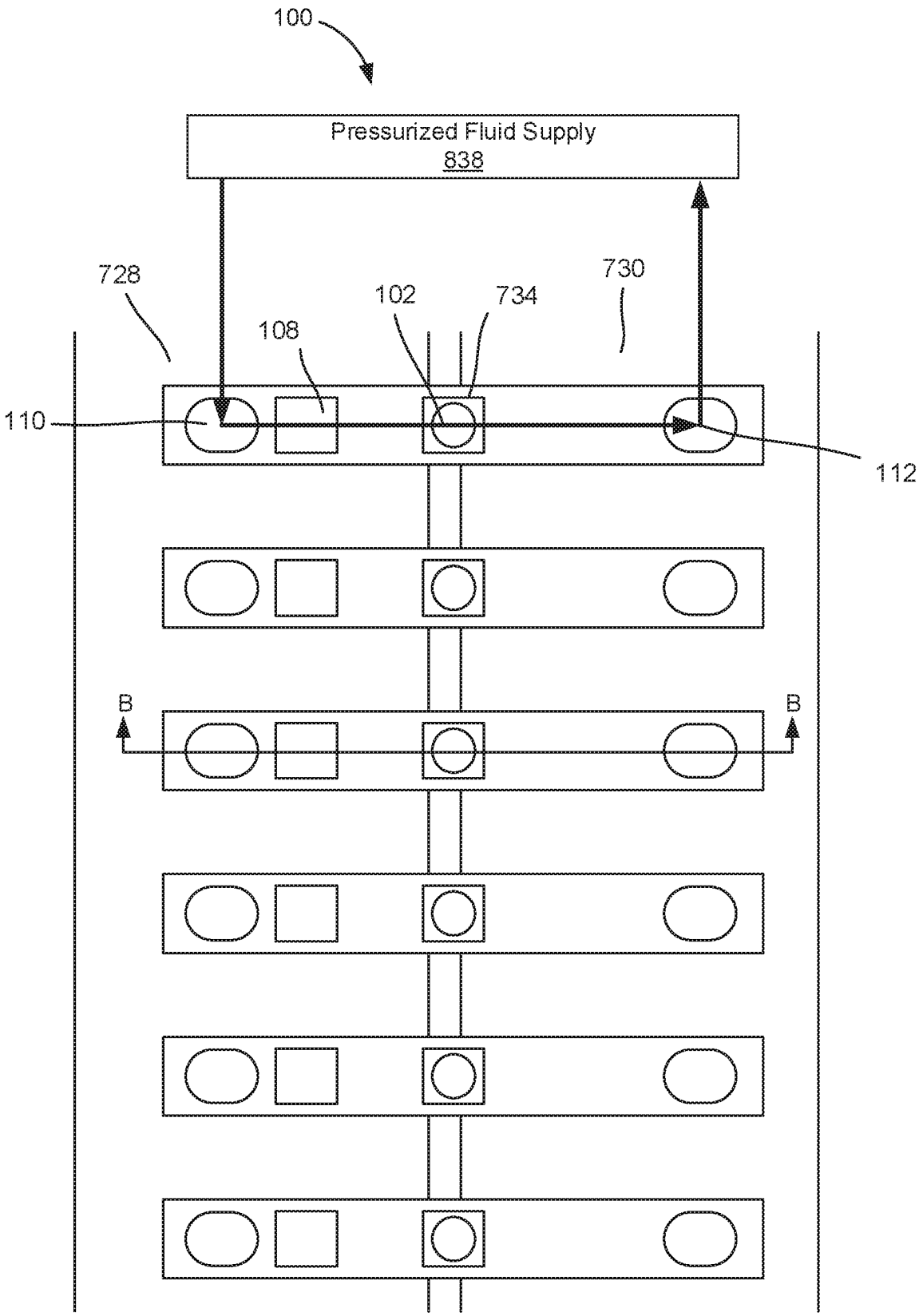
FIG. 8 is a planar view of the fluid ejection device with micropumps and pressure-difference based fluid flow, according to an example of the principles described herein.

FIG. 8 is a planar view of the fluid ejection device (100) with micropumps (108) and pressure-difference based fluid flow, according to an example of the principles described herein. FIG. 8 clearly shows the fluid path through the fluid ejection device (100). Note that in FIG. 8, a single instance of multiple components are indicated with reference numbers.

Returning to the fluid flow, fluid passes into an input channel (728) which may be disposed under an inlet passage (110). The fluid then passes through the inlet passage (110) where it is directed through the ejection chamber (FIG. 1B, 106) past the ejector (734). The ejector (734) is a component of the fluid ejection device (100) that operates to expel fluid through a nozzle (102). As with the micropump (108), the ejector (734) may be a thermal resistor, a piezoelectric component, or some other mechanical device. When activated, the ejector (734) creates energy which expels fluid through the nozzle (102).

Fluid that is not expelled is passed to the outlet passage (112) where it is transferred to the output channel (730). Thus, the fluid ejection device (100) provides for a micro-recirculation loop which allows effective delivery of fluid for ejection.

The flow through the recirculation loop is provided in part by a pressure differential between the input channel (728) and the output channel (730). Such a pressure differential is provided by a pressured fluid source (838) that is fluidically coupled to the input channel (728) and output channel (730), but remote from the fluid ejection device (100). Pressurized fluid source (838) creates a pressure gradient across the ejection chamber (106) such that the fluid supplied by pressurized fluid source (838) is circulated through and across the ejection chamber (106), reducing particle settling and transferring excess heat away from the ejector. The fluid discharged away from the ejection chamber (106) is not permitted to remix with the fluid entering the ejection chamber (106). As a result, any heat introduced by the ejector (734) is transferred away from the ejection chamber (106). In addition, because the pressurized fluid source (838) is remote from the fluid ejection device (100), pressurized fluid source (838) does not introduce additional heat to the fluid ejection device (100) or to the ejection chamber (106). As a result, fluid ejection errors caused by non-uniform or excessive temperature of the fluid within the ejection chamber (106) may be reduced.

As described above, in some cases it may be desirable to alter the fluid flow rate between the inlet passage (110) and the outlet passage (112). Accordingly, a micropump (108) fluidically coupled to a nozzle (102) may be actuated to either augment the flow in the differential flow direction or to counter the flow in the differential flow direction as described above. Thus, a customized flow past each nozzle (102) may be generated.

Figure 9A:
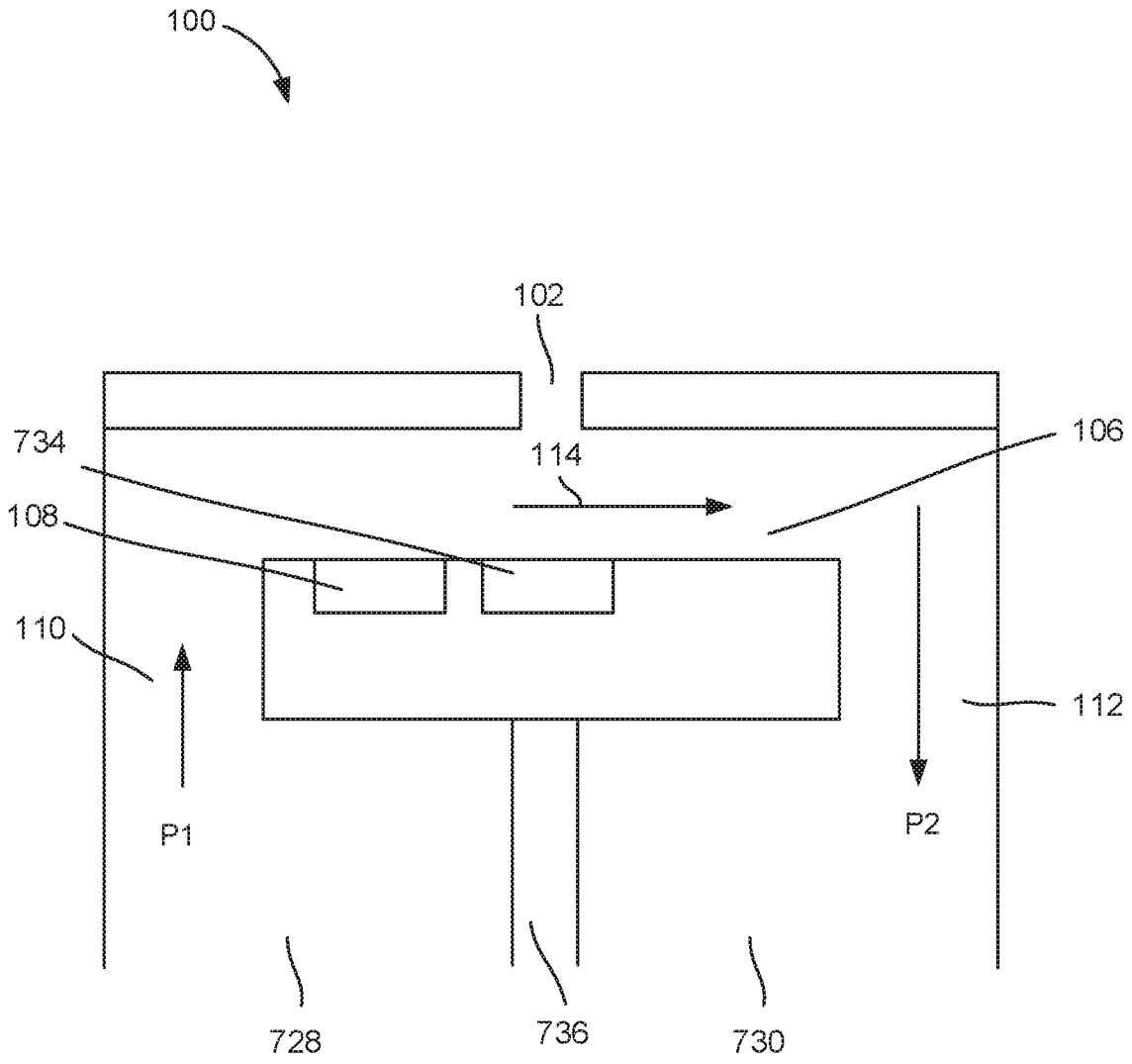
FIGS. 9A and 9B are cross-sectionals view of the fluid ejection device with micropumps and pressure-difference based fluid flow, according to an example of the principles described herein.
Figure 9B:
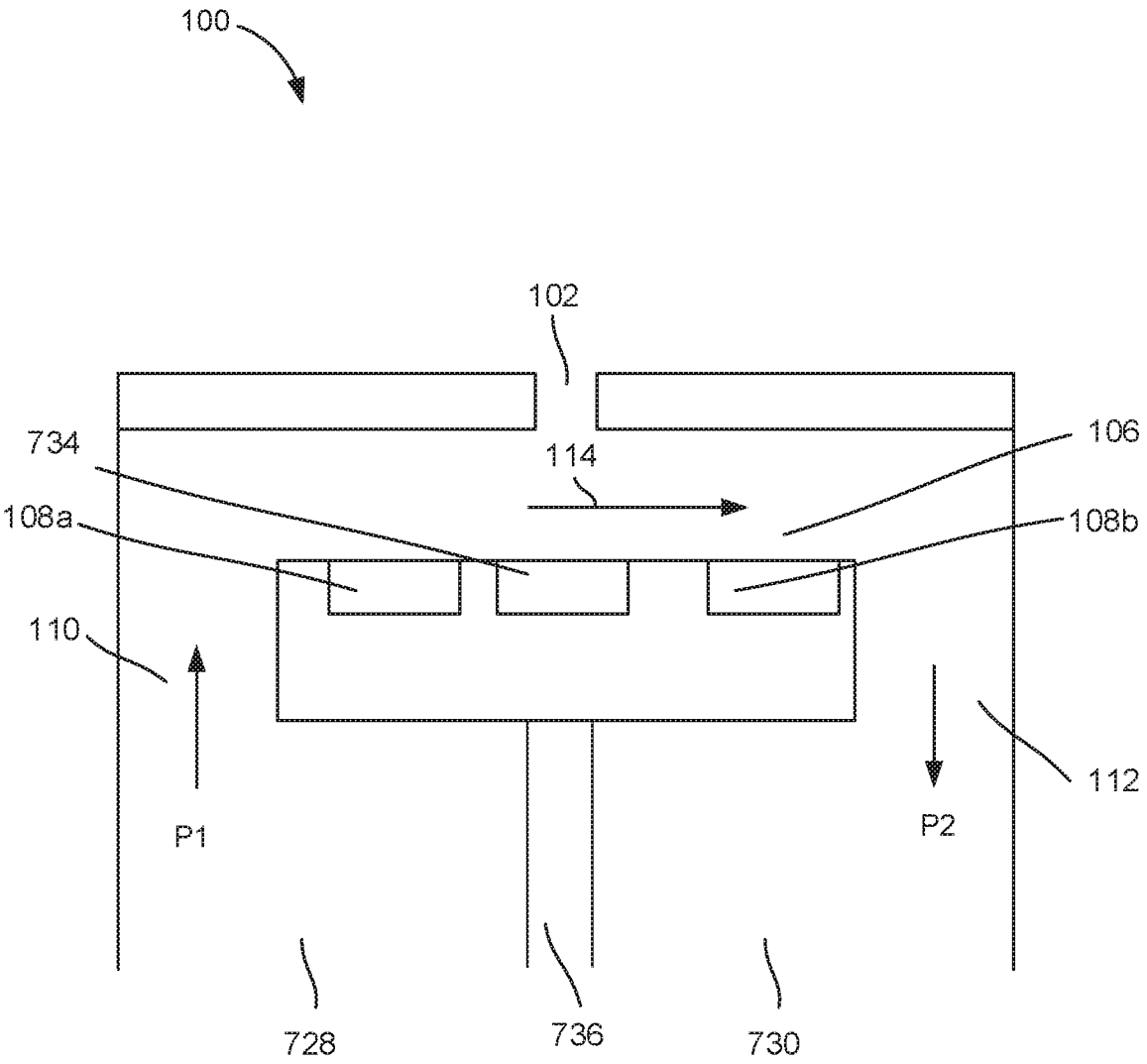

FIGS. 9A and 9B are cross-sectional views of the fluid ejection device (100) with micropumps (108) and pressure-difference based fluid flow, according to an example of the principles described herein. Specifically, FIG. 9A is a cross-sectional diagram taken along the line B-B in FIG. 6 and FIG. 9B is an example with two micropumps (108*a*, 108*b*), each disposed proximate to one of the inlet passage (110) and the outlet passage (112). Doing so allows for increased control as a fluid flow through an ejection chamber (106) may be increased at one point in time or decreased at another point in time. Thus, greater control is afforded to the fluid ejection system in controlling fluid flow rates. FIGS. 9A and 9B also clearly show the fluid flow from the input channel (728), through the inlet passage (110), through the ejection chamber (106) and out the outlet passage (112) to the output channel (730). FIGS. 9A and 9B also clearly depicts the rib (736) disposed underneath the ejector (734) to provide mechanical rigidity and stability to the fluid ejection device (100). As described above and as indicated in other figures, activation of the micropump (108) may serve to augment or counter the differential-based flow (114). Moreover, as the fluid passes by the ejector (734), the ejector (734) can be activated to expel fluid through the nozzle (102). The fluid ejection device (100) can be used to recirculate fluid such that fresh fluid is always provided to the ejection chamber (106), which fresh fluid results in a higher quality printed product.

Figure 10:
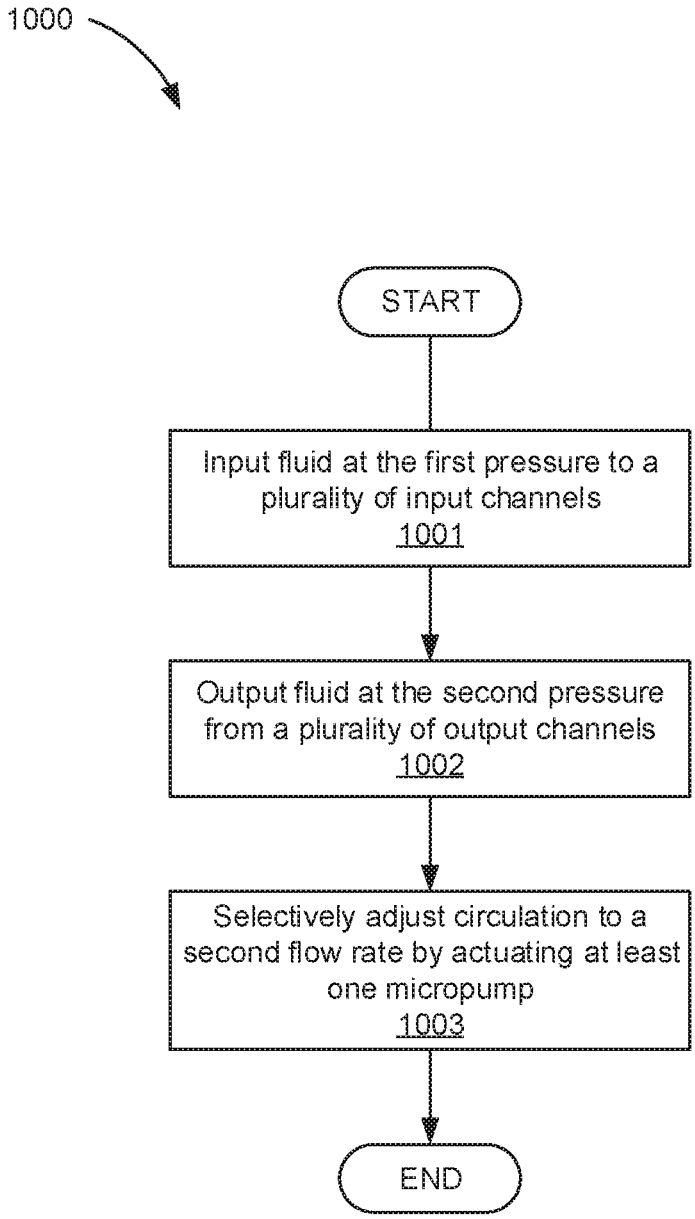
FIG. 10 is a flowchart of a method for fluid ejection with micropumps and pressure-difference based fluid flow, according to another example of the principles described herein.

FIG. 10 is a flowchart of a method (1000) for fluid ejection with micropumps (FIG. 1B, 108) and pressure-difference based fluid flow, according to another example of the principles described herein. As described above, fluid is circulated through an ejection chamber (FIG. 1B, 106) at a pressure differential. In some examples, this may include inputting (block 1001) fluid at the first pressure to input channels (FIG. 7, 728) that are fluidically coupled to respective ejection chambers (FIG. 1B, 106) and to output (block 1002) the fluid at a second pressure form output channels (FIG. 7, 730) that are fluidically coupled to respective ejection chambers (FIG. 1B, 106). This may be performed by a pressurized fluid source (FIG. 8, 838). Following such input and output, as described above, the circulation may be selectively adjusted (block 1003) by activating micropumps (FIG. 1B, 108).

Figure 11:
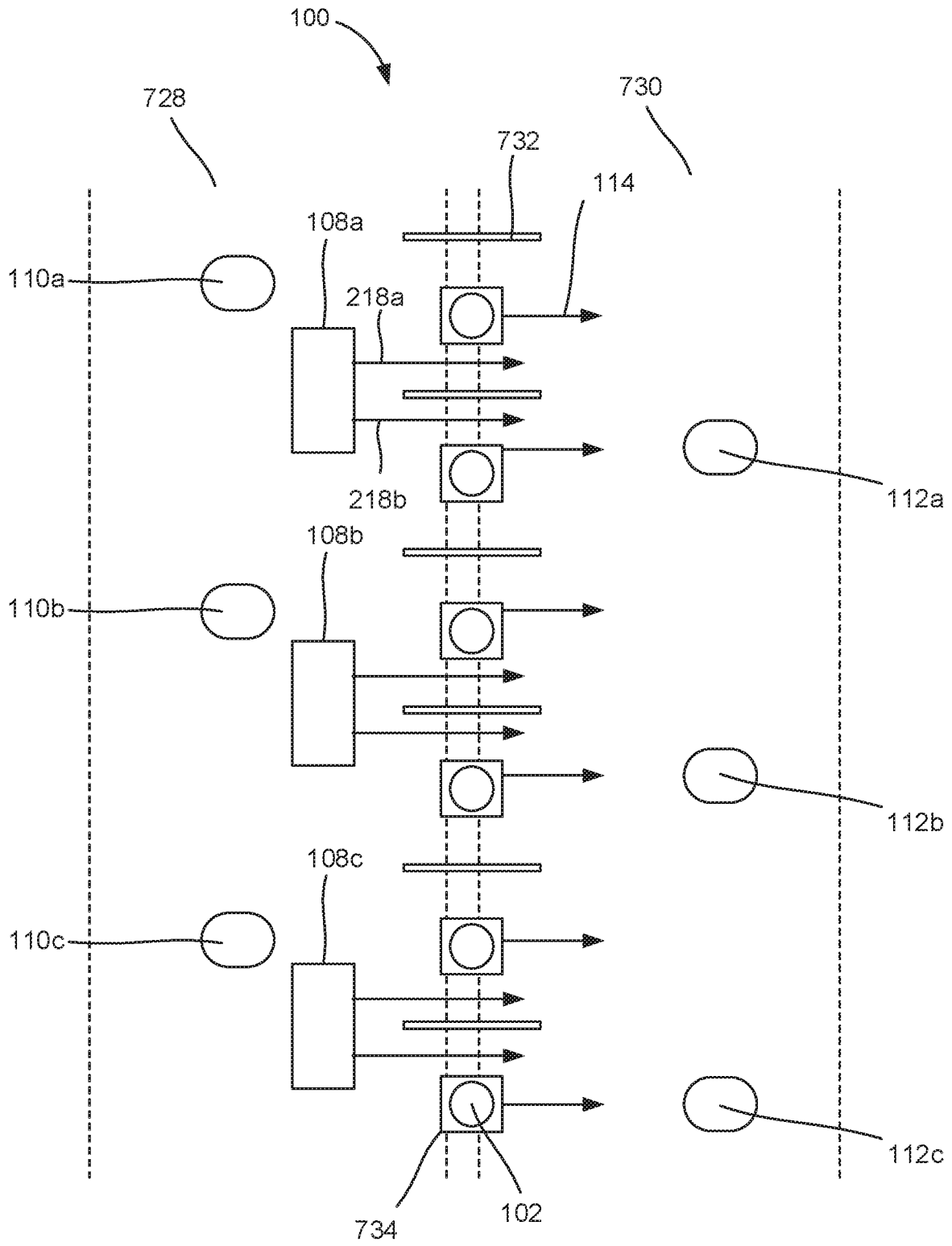
FIG. 11 is a planar view of a fluid ejection device with micropumps and pressure-difference based fluid flow, according to another example of the principles described herein.

FIG. 11 is a planar view of a fluid ejection device (100) with micropumps (10*b*) and pressure-difference based fluid flow, according to another example of the principles described herein. For simplicity, in FIG. 11 a single instance of various components are indicated with a reference number.

In the example depicted in FIG. 11, the number of ejection chambers (FIG. 1B, 106) and corresponding nozzles (102) and ejectors (734) does not match the number of inlet passages (110), outlet passages (112), and/or fluid micropumps (108). For example, as depicted in FIG. 11, the fluid ejection device may include six nozzles (102), ejectors (734), and corresponding ejection chambers (FIG. 1B, 106), the fluid ejection device (100) may include fewer micropumps (108*a-c*). That is, in this example, one micropump (108) may direct flow to multiple ejection chambers (FIG. 1B, 106). For example, a flow (114) of fluid may pass by each nozzle (102) with a first flow rate. This flow rate is adjusted as a flow (218*a-b*) resulting from an actuation of a micropump (108) combines with the differential flow (114). Such a system may simplify the manufacture of the fluid ejection device (100) as fewer micropumps (108) may be used in the system.

Still further, the number of ejection chambers (FIG. 1B, 106), nozzles (102), and ejectors (734) may be greater or less than the number of inlet passages (110) and outlet passage (112). For example, as depicted in FIG. 11, the fluid ejection system (100) may include six ejection chambers (FIG. 1B, 106), nozzles (102), and ejectors (734), but may include three each of an inlet passage (110*a-c*), and an outlet passage (112*a-c*). Doing so may provide different fluid dynamics which may be desirable for any number of reasons. For example, if more inlet passages (110*a-c*) are provided than nozzles (102), the ejection chambers (FIG. 1B, 106) may refill at a faster rate and be less susceptible to failure if one inlet passage (110*a-c*) becomes blocked.

Moreover, while FIG. 9 depicts a certain number, orientation, and size of micro-pumps (108), inlet passages (110), and outlet passages (112), any number size, and orientation of these components may be implemented in accordance with the principles described herein.

FIG. 11 also depicts the chamber walls (732) that define in part the different ejection chambers (FIG. 1B, 106). In the example depicted in FIG. 11, the fluid may pool as it is received through the inlet passages (110*a-c*). That is, fluid may not pass through well-defined ejection chambers (FIG. 1B, 106). Accordingly, the chamber walls (732) serve to guide fluid flow past and the ejection chambers (FIG. 1B, 106).

Figure 12:
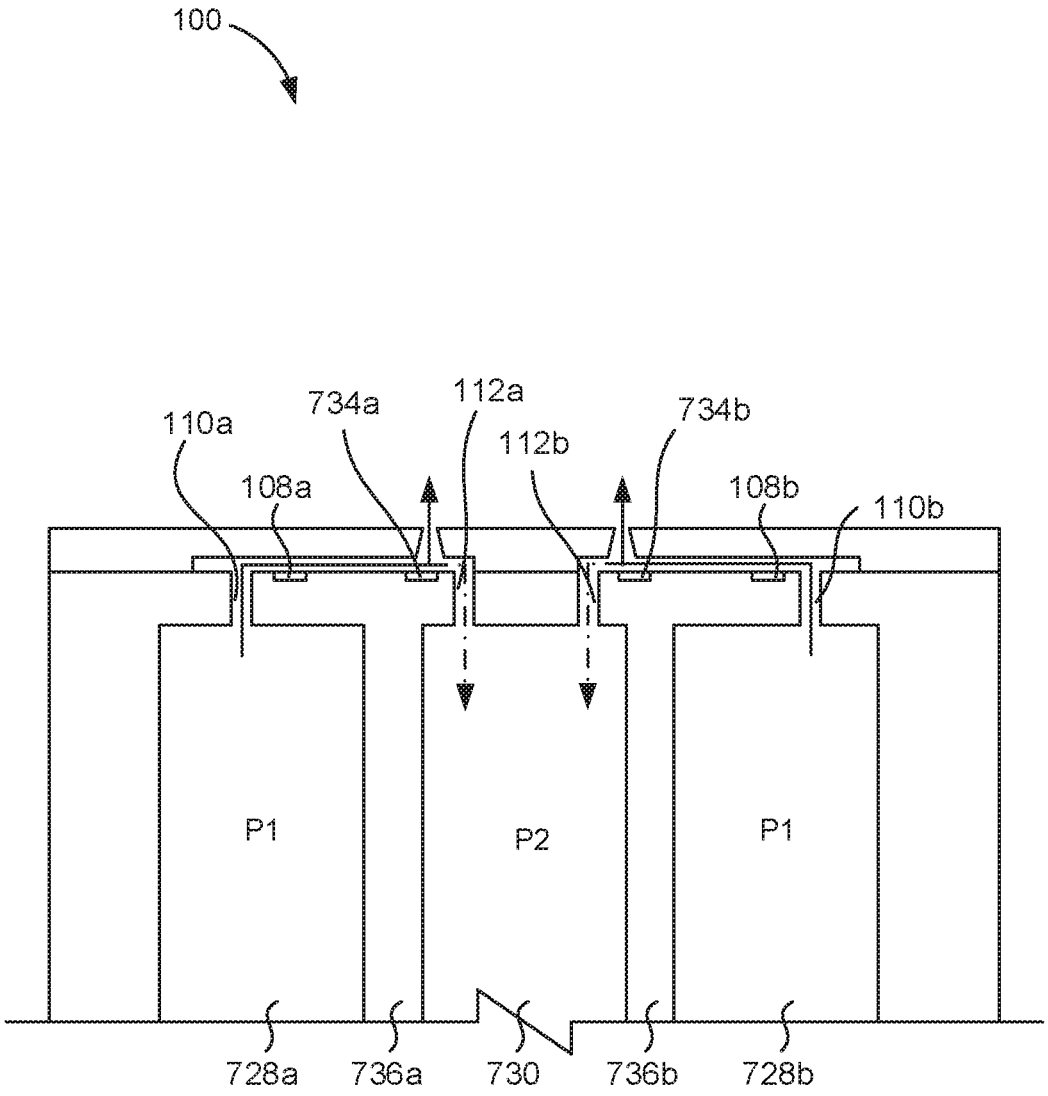
FIG. 12 is a diagram of a fluid ejection device with micropumps and pressure-difference based fluid flow, according to another example of the principles described herein.

FIG. 12 is a diagram of a fluid ejection device (100) with micropumps (108*a-b*) and pressure-difference based fluid flow, according to another example of the principles described herein. In some examples, adjacent outlet passages (112*a-b*) that correspond to adjacent ejection chambers (FIG. 1B, 106) are fluidically coupled to a common fluid output channel (730). FIG. 112 depicts such an example. In the example depicted in FIG. 12, the micropumps (108*a-b*) are disposed upstream of the nozzles (FIG. 1A, 102) and ejectors (734*a-b*). However, in other examples, the fluid micropumps (108*a-b*) may be disposed downstream of the nozzles (FIG. 1A, 102) and ejectors (734*a-b*).

In this example, fluid at a first pressure, P1, is passed to the fluid ejection device (100) via a first input channel (728*a*). As described above, the fluid moves through a first inlet passage (110*a*) past a first fluid micropump (108*a*) and first ejector (734*a*) to be expelled into the common output channel (730) via a first outlet passage (112*a*). In this example, a second pressure, P2, is generated in the output channel (730), which second pressure, P2, is less than the first pressure, P1.

Similarly, fluid at a first pressure, P1, is passed to the fluid ejection device (100) via a second input channel (728*b*). As described above, the fluid moves through a second inlet passage (110*b*) past a second micropump (108*b*) and second ejector (636*b*) to be expelled into the common output channel (730) via a second outlet passage (112*b*). In this example, a second pressure, P2, is generated in the output channel (730). Such a system where adjacent ejection chambers (FIG. 1B, 106) empty into a common output channel (730) provides even more possibilities for the configuration of a fluid ejection system (100) and can reduce the size and cost of the fluid ejection device (100) by relying on fewer output channels (730) and associated fluidic interconnections and components.

Figure 13:
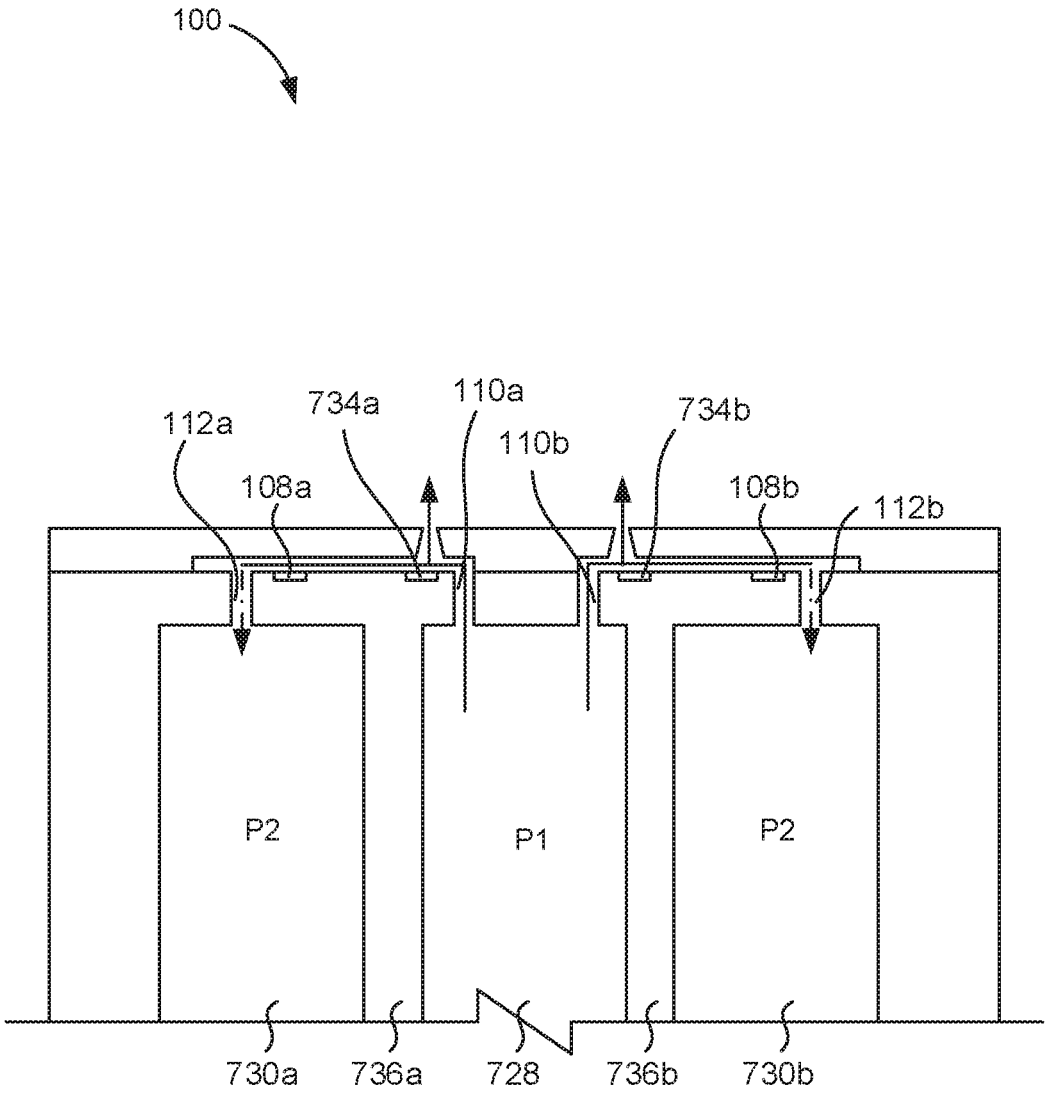
FIG. 13 is a diagram of a fluid ejection device with micropumps and pressure-difference based fluid flow, according to another example of the principles described herein.

FIG. 13 is a diagram of a fluid ejection device (100) with micropumps (108*a-b*) and pressure-difference based fluid flow, according to another example of the principles described herein. In some examples, adjacent inlet passages (110*a-b*) that correspond to adjacent ejection chambers (FIG. 1B, 106) are fluidically coupled to a common fluid input channel (728). FIG. 13 depicts such an example. In the example depicted in FIG. 13, the fluid micropumps (108*a-b*) are disposed downstream of the nozzles (FIG. 1A, 102) and ejectors (734*a-b*). However, in other examples, the fluid micropumps (108*a-b*) may be disposed upstream of the nozzles (FIG. 1A, 102) and ejectors (734*a-b*).

In this example, fluid at a first pressure, P1, is passed to the fluid ejection device (100) via a common input channel (728). As described above, the fluid moves through a first inlet passage (110*a*) past a first fluid micropump (108*a*) and first ejector (734*a*) to be expelled into the first output channel (730*a*) via a first outlet passage (112*a*). In this example, a second pressure, P2, is generated in the first output channel (730*a*). Which second pressure, P2, is less than the first pressure, P1.

Figure 14:
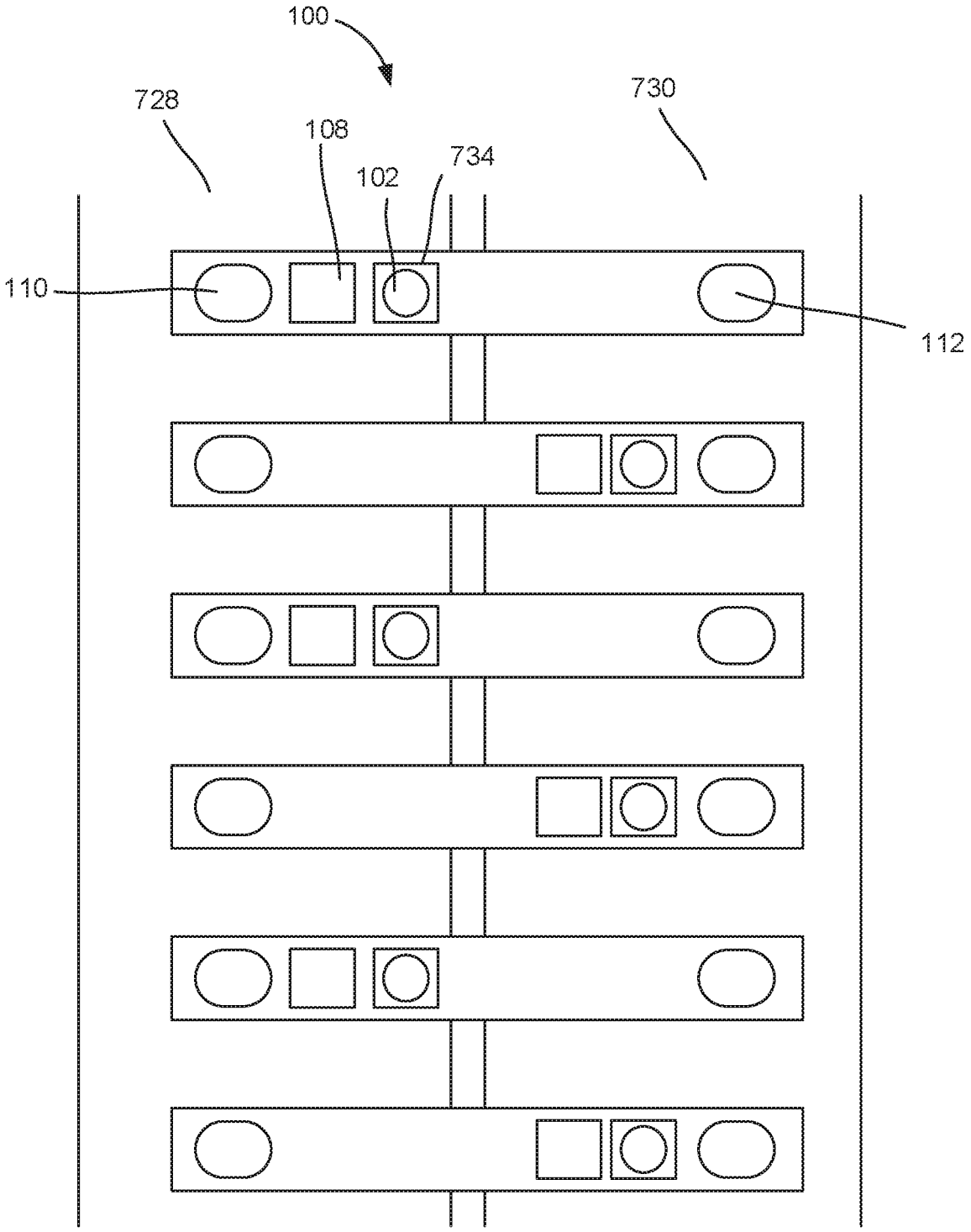
FIG. 14 is a diagram of a fluid ejection device with micropumps and pressure-difference based fluid flow, according to another example of the principles described herein.

Similarly, fluid at a first pressure, P1, is passed to the fluid ejection device (100) via the common input channel (728). As described above, the fluid moves through a second inlet passage (110*b*) past a second fluid micropump (108*b*) and second ejector (734*b*) to be expelled into the second output channel (730*b*) via a second outlet passage (112*b*). In this example, a second pressure, P2, is generated in the second output channel (730*b*). Such a system where adjacent ejection chambers (FIG. 1B, 106) draw from a common input channel (728) provides even more possibilities for the configuration of a fluid ejection system (100) and can reduce the size and cost of the system by requiring less output channels and associated fluidic interconnections and components FIG. 14 is a diagram of a fluid ejection device (100) with micropumps (108) and pressure-difference based fluid flow, according to another example of the principles described herein. In some examples, the nozzles (102), ejectors (734), and micropumps (108) may not align with one another along a column of nozzles (102). That is, as described above, the plurality of nozzles (102) disposed on a fluid ejection device (100) may be arranged into particular columns. In some examples, such as that depicted in FIG. 14, the nozzles (102) and ejectors (734) may not align with one another. Moreover, in these examples, the corresponding micropumps (108) also may be staggered in a direction perpendicular to the direction of flow through the ejection chambers (FIG. 1B, 106). Such nozzle arrangements may provide for a more efficient drop pattern, and thereby a higher print quality.

Figure 15A:
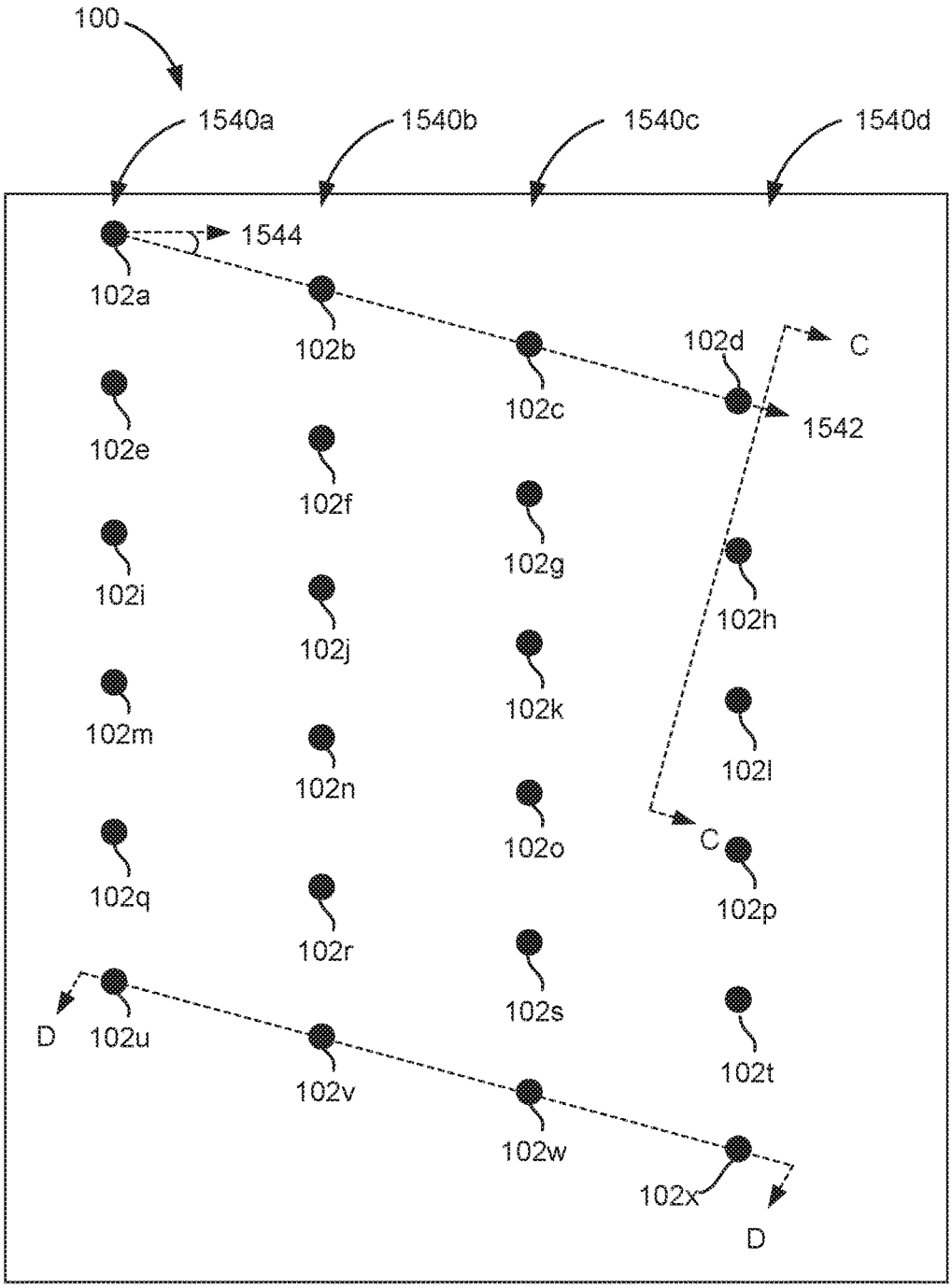
FIGS. 15A-15C are views of a fluid ejection devices with micropumps and pressure-difference based fluid flow, according to another example of the principles described herein.
Figure 15B:
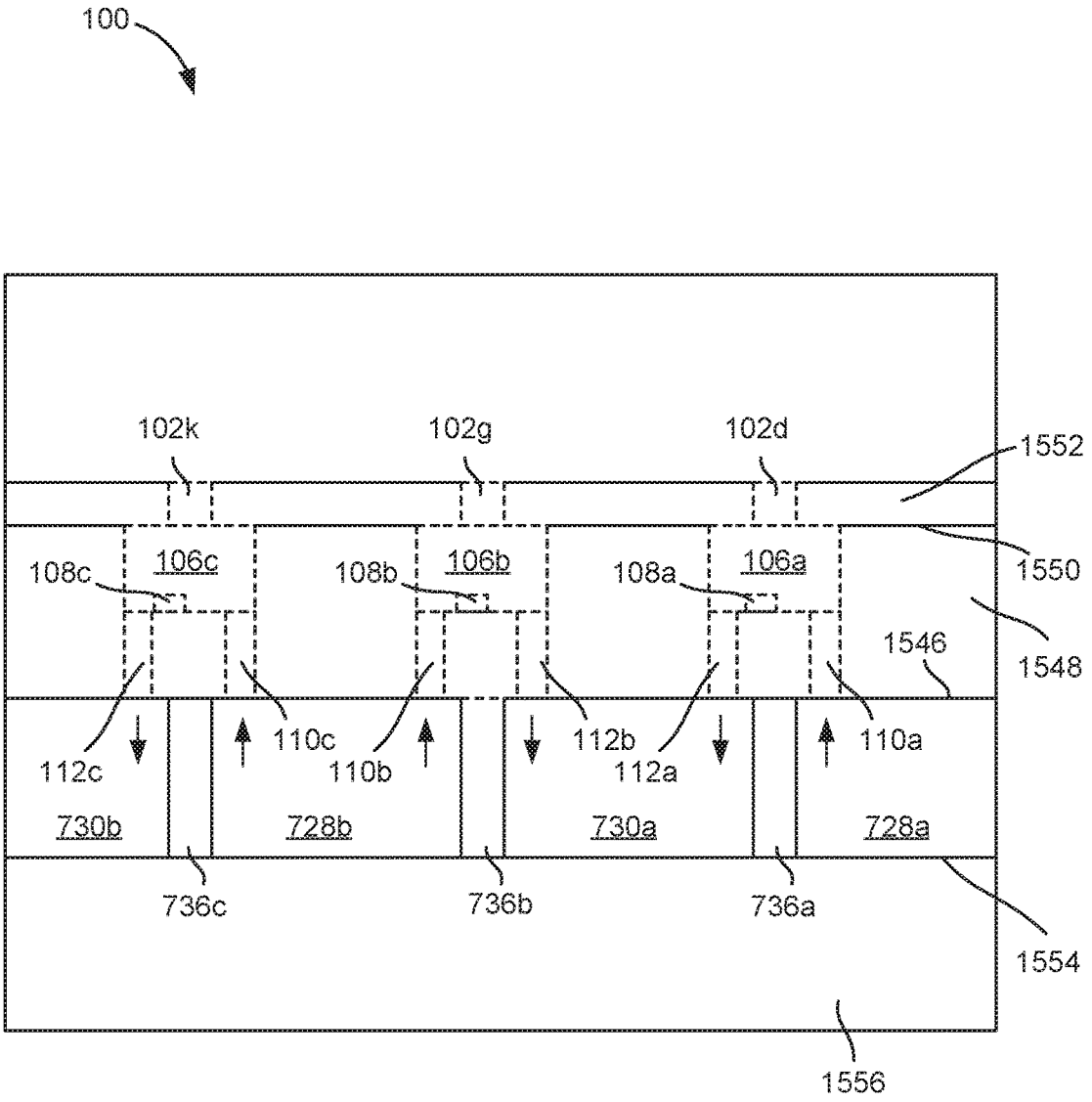
Figure 15C:
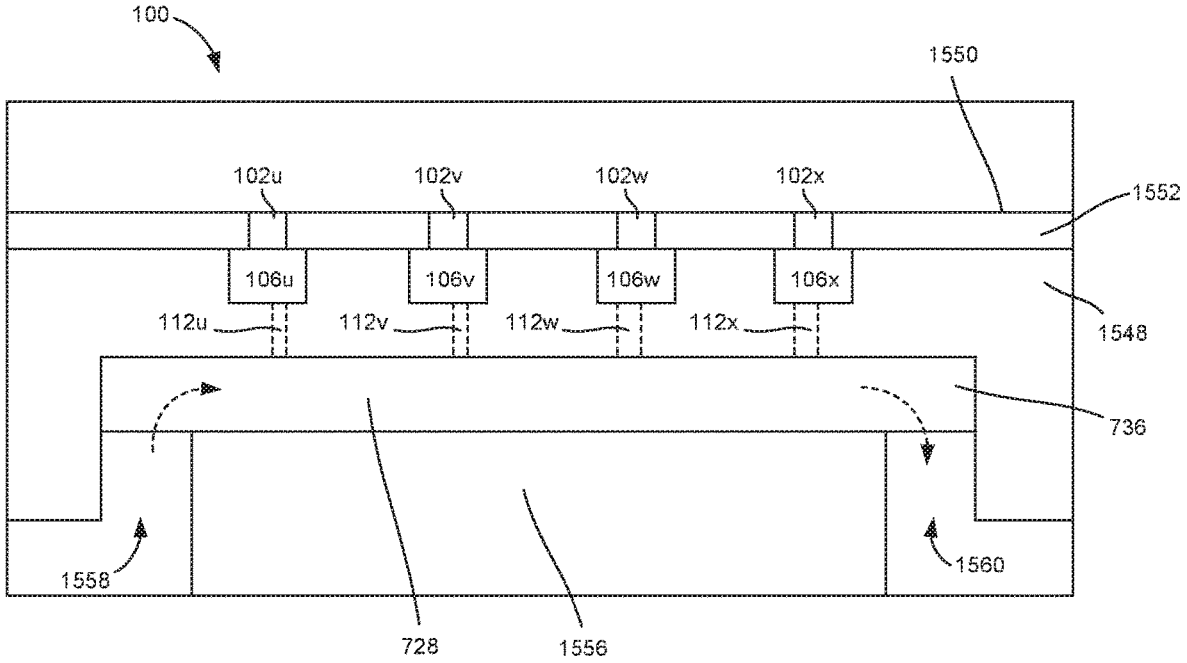

FIGS. 15A-15C are views of fluid ejection devices (100) with micropumps (FIG. 1B, 108) and pressure-difference based fluid flow, according to another example of the principles described herein. Specifically, FIG. 15A provides an example fluid ejection device (100) that includes a plurality of nozzles (102*a-x*) arranged along the device length and the device width in at least four nozzle columns (1540*a-d*). In this example, a set of neighboring nozzles (102*a-x*) may include four nozzles (e.g., a first set of neighboring nozzles may be a first nozzle (102*a*) through a fourth nozzle (102*d*)). Furthermore, nozzles within a neighboring nozzle group may be arranged along a diagonal (1542) with respect to the length and width of the fluid ejection device (100). An example angle of orientation (1542) is provided between the first nozzle (102*a*) and a second nozzle (102*b*), where the angle of orientation (1544) may correspond to the diagonal (1542) along which neighboring nozzles may be arranged. In some examples, the diagonal (1542) along which neighboring nozzles (102*a-x*) may be arranged may be oblique with respect to the length of the fluid ejection device (100), and the diagonal (1542) may be oblique with respect to the width of the fluid ejection device (100). In examples, each set of neighboring nozzles (e.g., the first nozzle (102*a*) to the fourth nozzle (102*d*); a fifth nozzle (102*e*) to an eighth nozzle (102*h*); etc.) may be arranged along parallel diagonals. Similarly the channels (728, 730) and ribs (736) may be arranged in an oblique orientation with respect to the nozzle columns (1540).

FIG. 15B provides a cross-sectional view along view line C-C of FIG. 15A, and FIG. 15C provides a cross-sectional view of the example fluidic ejection device (100) of FIG. 15A along view line D-D. In this example, the fluid ejection device (100) includes an array of ribs (676*a-c*) that define the input channels (728*a-b*) and output channels (730*a-b*). Furthermore, the cross-sectional view of FIG. 15B includes dashed line depictions of the fourth nozzle (102*d*), a seventh nozzle (102*g*), and an 11th nozzle (102*k*) to illustrate the relative positioning of such nozzles (102*d*, 102*g*, 102*k*) with respect to the ribs (736*a-c*) of the array of ribs and the channels (728*a-b*, 730*a-b*) defined thereby. Referring to FIG. 15C, this figure includes dashed line representations of a 21st nozzle (102*u*), a 22nd nozzle (102*v*), a 23rd nozzle (102*w*), and a 24th nozzle (102*x*).

Furthermore, it may be appreciated that the view line C-C along which the cross-sectional view is presented is approximately orthogonal to the diagonal (1542) along which sets of neighboring nozzles may be arranged. Accordingly, other nozzles of the neighboring nozzle sets in which the fourth nozzle (102*d*), the seventh nozzle (102*g*), and the 11th nozzle (102*k*) are grouped may be aligned with the depicted nozzles in the cross-sectional view. Similarly, it may be appreciated that other nozzles of the first nozzle column (1540*a*), second nozzle column (1540*b*), third nozzle column (1540*c*), and fourth nozzle column (1540*d*) may be aligned with the example nozzles (102*u-x*) illustrated in the cross-sectional view of FIG. 15C.

In addition, as shown in dashed line, each respective nozzle (102*d*, 102*g*, 102*k*, 102*u-x*) may be fluidically coupled to a respective fluid ejection chamber 106*a-c*, 106*u-x*. While not shown, the fluid ejection device (100) may include, in each fluid ejection chamber (106*a-c*, 106*u-x*) at least one ejector. Furthermore each fluid ejection chamber (10*ca-c*, 106*u-x*) may include a micropump (108*a-c*). Furthermore, each respective fluid ejection chamber (106*a-c*, 106*u-x*) may be fluidically coupled to a respective inlet passage (110*a-c*), and each respective fluid ejection chamber (106*a-c*, 106*u-x*) may be fluidically coupled to a respective outlet passage (112*a-c*). In the cross-sectional view of FIG. 15C, the inlet passages, and micropumps are not shown, as the cross-sectional view line is positioned such that the inlet passages and micropumps are not included. The outlet passages (112*u-x*) for a respective ejection chamber (106*u-x*) are illustrated in dashed line because it may be spaced apart from the view line.

In this example, a top surface of each rib (736*a-c*) of the array of ribs may be adjacent to and engage with a bottom surface (1546) of a substrate (1548) in which the ejection chambers and passages may be at least partially formed. Accordingly, the bottom surface (1546) of the substrate may form an interior surface of the input channels (728*a-b*) and output channels (730*a-b*). As shown in FIG. 15B, the bottom surface (1546) of the substrate may be opposite a top surface (1550) of the substrate (1548), where the top surface (1550) of the substrate (1548) may be adjacent a nozzle layer (1552) in which the nozzles (102*d*, 102*g*, 102*k*) may be formed. In this example, a portion of the fluid ejection chambers (106*a-c*, 106*u-x*) may be defined by a surface of the nozzle layer (1552) disposed above the portion of the fluid ejection chambers (106*a-c*) formed in the substrate (1548). In other examples, ejection chambers, nozzles, and feed holes may be formed in more or less layers and substrates. A bottom surface of each rib (736*a-c*) may be adjacent to a top surface (1554) of an interposer (1556). Accordingly, in this example, the input channels (728*a-b*) and output channels (730*a-b*) may be defined by the ribs (736*a-c*), the substrate (1548), and the interposer (1556). Accordingly, as shown FIGS. 15B-15C, the fluid ejection device (100) includes an array of passages (110*a-c*, 112*a-c*, 112*u-x*) formed through the bottom surface of the fluid ejection device (100).

In examples similar to the example of FIGS. 15A-C, channels may be arranged to facilitate circulation of fluid through ejection chambers. In the example, the inlet passages (110*a-c*) may be fluidically coupled to a respective input channel (728*a-b*) such that fluid may be conveyed from the respective input channel (728*a-b*) to the respective fluid ejection chamber (106*a-c*, 106*u-x*) via the respective inlet passage (110*a-c*). Similarly, each respective outlet passage (112*a-c*, 112*u-x*) may be fluidically coupled to a respective output channel (730*a-b*) such that fluid may be conveyed from the respective fluid ejection chamber (106*a-c*, 106*u-x* to the respective output channel (730*a-b*) via the respective outlet passages (112*a-c*, 112*u-x*). The respective input channels (728*a-b*) and the respective output channels (730*a-b*) may be fluidly separated by the ribs (736*a-c*) along some portions of the device such that fluid flow may occur solely through the passages (110*a-c*, 112*a-c*) and the ejection chambers (106*a-c*).

Some fluid input to the ejection chambers (106*a-c*) may be ejected via the nozzles (102*d*, 102*g*, 102*k*) as fluid drops. However, to facilitate circulation through the ejection chambers (106*a-c*), some fluid may be conveyed from the ejection chambers (106*a-c*) back to the respective output channels (730*a-b*).

Referring to FIGS. 15A and 15B, it should be noted that the ribs (735*a-c*) of the array of ribs, and the channels (728*a-b*, 730*a-b*) partially defined thereby may be parallel to the diagonals (1542) through which neighboring nozzles (102*a-x*) are also arranged. Furthermore, as shown, in this example, the respective inlet passages of nozzles (102*a-x*) of sets of neighboring nozzles may be commonly coupled to a respective input channel (728*a-b*), and the respective outlet passages of nozzles (102*a-x*) of sets of neighboring nozzles may be commonly coupled to a respective output channel (730*a-b*). In this example, the fluidic arrangement of the ejection chambers (106*a-c*), the inlet passages (110*a-c*), and the outlet passages (112*a-c*) may be described as straddling respective ribs (736*a-c*) of the array of ribs.

For example, as shown in FIG. 15B, the respective inlet passage (110*b*) coupled to the seventh nozzle (102*g*) and the respective inlet passage (110*c*) coupled to the 11th nozzle (102*k*) are fluidically coupled to a respective input channel (728). Similarly, the respective outlet passage (112*a*) coupled to the fourth nozzle (102*d*) and the respective outlet passage (112*b*) coupled to the seventh nozzle (102*g*) are fluidically coupled to a respective output channel (730*a-b*). Since neighboring nozzles (102*a-x*) are aligned with the nozzles (102*d*, 102*g*, 102*k*) shown in FIG. 15B along a respective rib (736*a-c*), it may be noted that passages associated with neighboring nozzles of each respective nozzle shown (102*d*, 102*g*, 102*k*) may be similarly arranged.

As shown in FIG. 15B, ejection chambers (106*a-c*) may be disposed in the substrate above respective ribs (736*a-c*), and the passages (110*a-c*, 112*a-c*) coupled to a respective ejection chamber (106*a-c*) may be positioned on opposite sides of the respective rib (736*a-c*) such that fluid input to the respective ejection chamber (106*a-c*) via the respective inlet passage (110*a-c*) may be fluidly separated from fluid output from the respective ejection chamber (106*a-c*) via the respective outlet passage (112*a-c*).

As shown in FIGS. 15B-C, the top surface (1554) of the interposer (1556) may form a surface of the channels (728*a-b*, 730*a-b*). Furthermore, the interposer (1556) may be positioned with respect to the substrate (1548) and the ribs (736*a-c*) such that a fluid input (1558) and a fluid output (1560) may be at least partially defined by the interposer (1556) and/or the substrate (1548). In such examples, the fluid input (1558) may be fluidically coupled to the channels (728*a-b*, 730*a-b*), and the fluid output (1560) may be fluidically coupled to the channels (728*a-b*, 730*a-b*).

Figure 16:
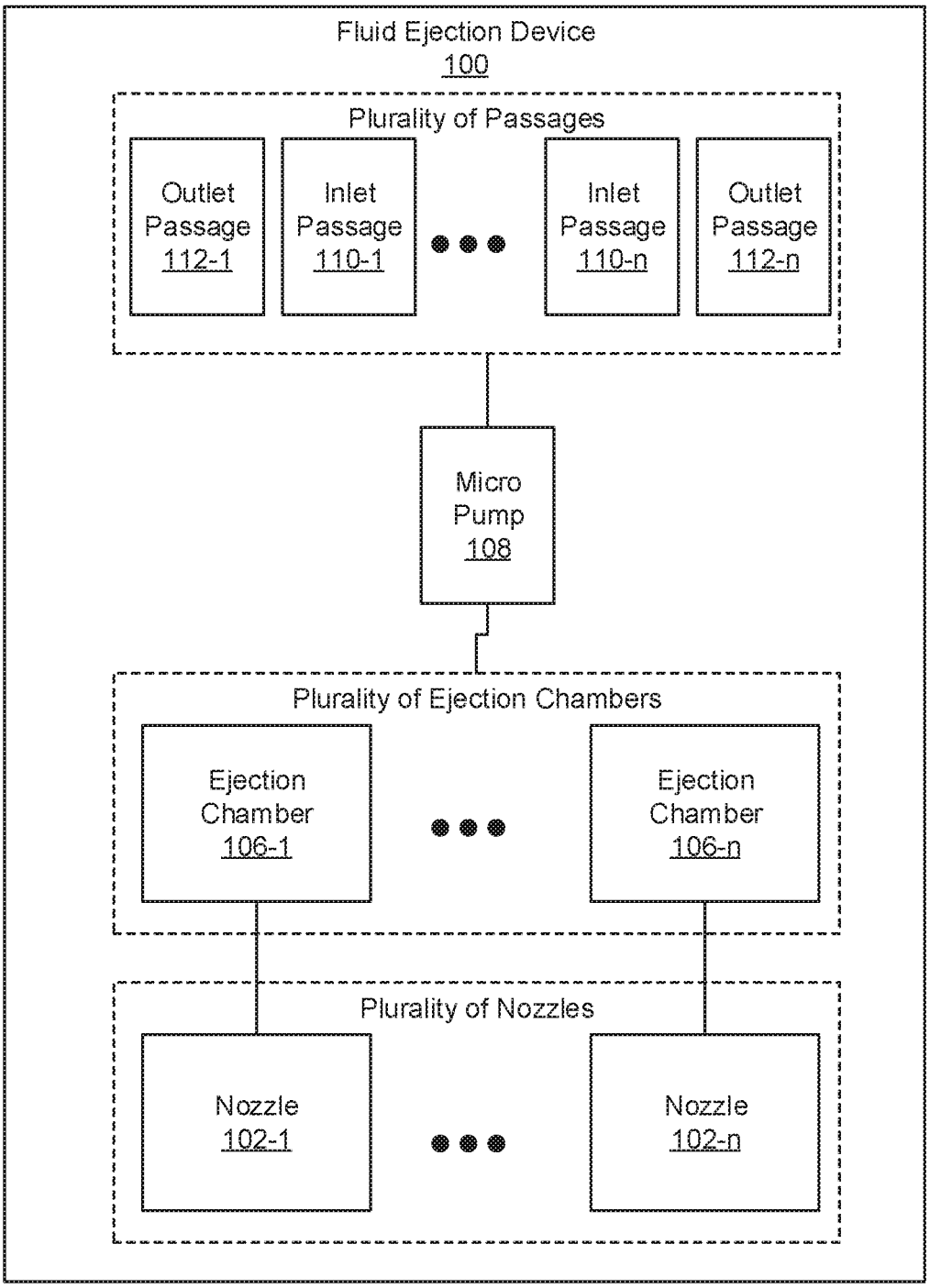
FIG. 16 is a block diagram of a fluid ejection device with micropumps and pressure-difference based fluid flow, according to another example of the principles described herein.

FIG. 16 is a block diagram of a fluid ejection device (100) with micropumps (108) and pressure-difference based fluid circulation, according to another example of the principles described herein. FIG. 16 depicts the fluid ejection device (100) which includes a plurality of nozzles (102-1, **102-*n*) distributed across a length and width of the fluid ejection device (100) such that at least one respective pair of neighboring nozzles are positioned at different width positions along the width of the fluid ejection device (100). The fluid ejection device (100) further includes a plurality of ejection chambers (106-1, 106-*n*) that includes, for each respective nozzle (102), a respective ejection chamber (106) that is fluidically coupled to the nozzle (102). The fluid ejection device (100) further includes at least one fluid actuator disposed in each ejection chamber (106). The fluid ejection device (100) further includes an array of inlet passages (110-1, 110-*n*) and outlet passages (112-1, 112-*n*) formed on a surface of the fluid ejection device (100) opposite a surface through which the nozzles (102) are formed. In this example, the array of inlet passages (110) and outlet passages (112) includes at least one respective passage (110, 112) fluidically coupled to each ejection chamber (106). FIG. 16 also depicts the micropump (108) coupled to ejection chambers (106) to adjust a flow rate through the ejection chambers (106**).

Figure 17:
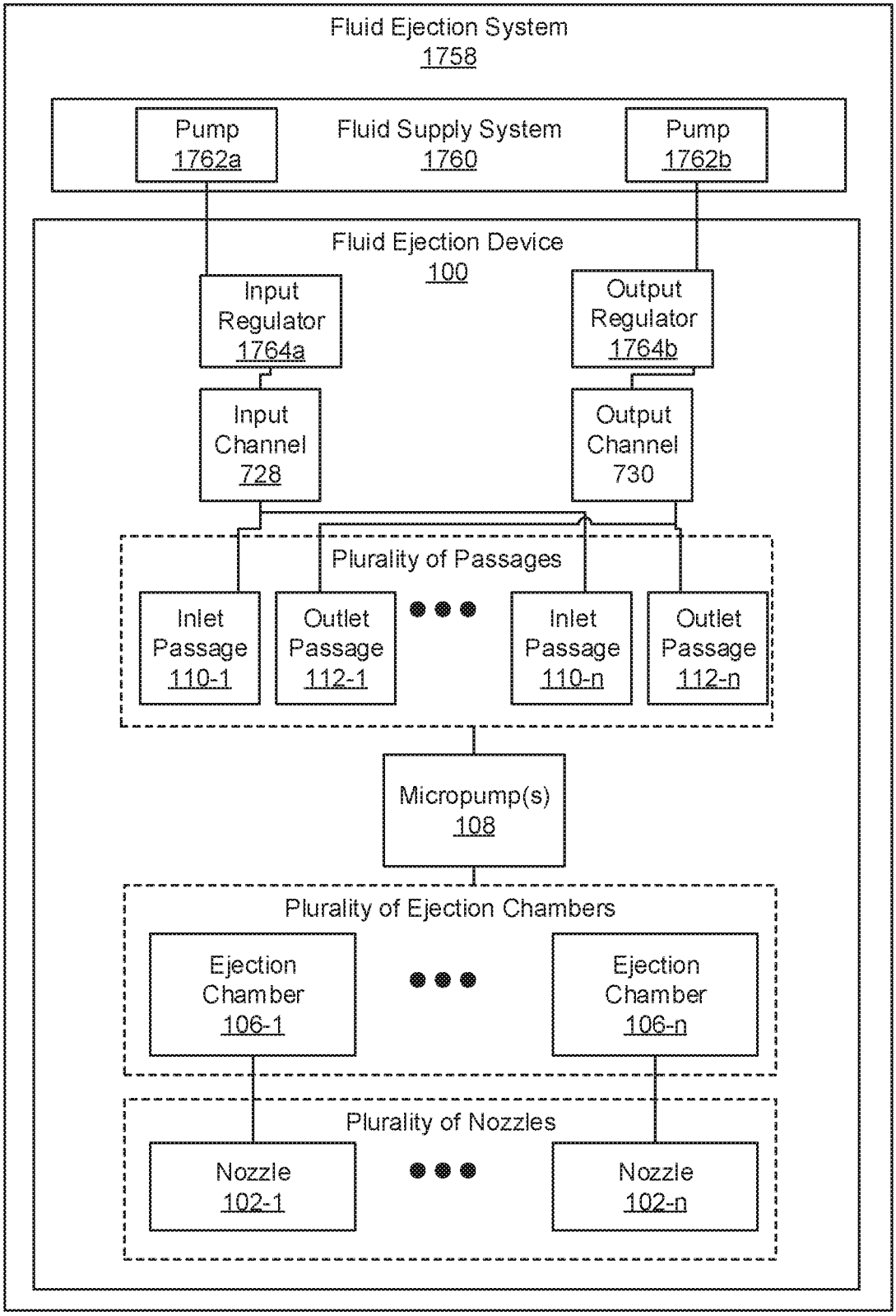
FIG. 17 is a block diagram of a fluid ejection system with micropumps and pressure-difference based fluid flow, according to another example of the principles described herein.

FIG. 17 is a block diagram of a fluid ejection system (1758) with pressure-difference based fluid circulation, according to another example of the principles described herein. In this example, the fluid ejection device (100) includes the nozzles (102) and ejection chambers (106) as described above. The fluid ejection device (100) also includes micropump(s) (108). In some examples, the micropump(s) may be coupled to one or many ejection chambers (106).

In this example, each respective inlet passage (110) may be fluidically coupled to a respective input channel (728), and each respective outlet passage (112) may be fluidically coupled to a respective output channel (730).

The fluid ejection system (1758) also includes a fluid supply system (1760) that supplied fluid to the fluid ejection device (100). A fluid supply system may include fluid supply components, such as pumps (**1762*a-b*) to drive fluid towards the fluid ejection device (100). The fluid supply system (1760) may also include other components such as regulators, tanks, and other such components that apply fluid pressure differentials to the fluid supply system and fluid ejection devices connected thereto to thereby drive fluid through these fluid supply components and fluid ejection devices connected thereto. To further generate the pressure differential, the fluid ejection device (100) includes an input regulator (1764*a*) fluidically coupled to the fluid supply system (1730) and the input channel (728). The input regulator (1764*a*) establishes a first pressure for supply fluid. The fluid ejection device (100) also includes an output regulator (1764*b*) fluidically coupled to the fluid supply system (1730) and the output channel (728). The output regulator (1764*g***) establishes a second pressure for collected fluid.

What is claimed is:

1. A fluid ejection device, comprising:

a plurality of nozzles;

a plurality of ejection chambers, comprising a respective ejection chamber of the plurality of ejection chambers fluidically coupled to a respective nozzle of the plurality of nozzles;

a plurality of inlet passages which are fluidically coupled to the ejection chambers and input fluid to the ejection chambers at a first pressure;

a plurality of outlet passages which are fluidically coupled to the ejection chambers and to output fluid from the ejection chambers at a second pressure that is less than the first pressure such that fluid circulates through the ejection chambers based on the pressure difference between the first pressure and the second pressure; and at least one micropump fluidically coupled to ejection chambers to pump fluid through the ejection chambers.

2. The fluid ejection device of claim 1, wherein the at least one micropump is disposed proximate to the respective ejection chamber.

3. The fluid ejection device of claim 2, wherein the at least one micropump is upstream of a nozzle fluidically coupled to a respective ejection chamber to increase a flow rate through the respective ejection chamber.

4. The fluid ejection device of claim 2, wherein the at least one micropump is downstream of a nozzle fluidically coupled to a respective ejection chamber to decrease a flow rate through the respective ejection chamber.

5. The fluid ejection device of claim 1, wherein the at least one micropump comprises a thermal resistor.

6. The fluid ejection device of claim 1, wherein:

the at least one micropump comprises a piezoelectric membrane; and deflection of the piezoelectric membrane changes a flow rate through the at least one ejection chamber.

7. The fluid ejection device of claim 6, wherein:

responsive to the piezoelectric membrane being in a concave position, fluid flow is directed towards an outlet passage associated with the at least one ejection chamber; and responsive to the piezoelectric membrane being in a flat position, the pressure difference is augmented.

8. The fluid ejection device of claim 6, wherein:

responsive to the piezoelectric membrane being in a flat position, fluid flow is directed towards an outlet passage associated with the at least one ejection chamber; and responsive to the piezoelectric membrane being in a concave position, the pressure difference is countered.

9. The fluid ejection device of claim 1, wherein the at least one micropump comprises two micropumps, each disposed proximate to one of an inlet passage and an outlet passage.

10. A fluid ejection device comprising:

a plurality of nozzles;

a plurality of ejection chambers, comprising a respective ejection chamber of the plurality of ejection chambers fluidically coupled to a respective nozzle of the plurality of nozzles;

a plurality of inlet passages, comprising a respective inlet passage fluidically coupled to the respective ejection chamber;

a plurality of outlet passages, comprising a respective outlet passage fluidically coupled to the respective ejection chamber;

at least one input channel, the at least one input channel fluidically coupled to at least a subset of inlet passages of the plurality of inlet passages, the at least one input channel to supply fluid to the subset of inlet passages at a first pressure;

an input regulator to generate the first pressure in the fluid at the at least one input channel;

at least one output channel, the at least one output channel fluidically coupled to at least a subset of outlet passages of the plurality of outlet passages, the at least one output channel to receive fluid from the subset of outlet passages at a second pressure different than the first pressure to thereby facilitate fluid circulation through ejection chambers fluidically coupled to the subset of inlet passages and the subset of outlet passages;

an output regulator to generate the second pressure in the fluid at the at least one output channel; and at least one micropump fluidically coupled to at least one ejection chamber to pump fluid through the at least one ejection chamber.

11. The fluid ejection device of claim 10, wherein a number of ejection chambers is greater than at least one of:

a number of inlet passages; and a number of outlet passages.

12. The fluid ejection device of claim 10, wherein a number of ejection chambers is greater than a number of micropumps.

13. The fluid ejection device of claim 10, wherein adjacent outlet passages corresponding to adjacent ejection chambers are fluidically coupled to a common output channel.

14. The fluid ejection device of claim 10, wherein adjacent inlet passages corresponding to adjacent ejection chambers are fluidically coupled to a common input channel.

15. The fluid ejection device of claim 10, further comprising an array of ribs that define the at least one input channel and the at least one output channel, wherein:

the plurality of nozzles are arranged in nozzle columns;

the plurality of nozzles are arranged in respective sets of neighboring nozzles that are diagonally arranged with respect to the length and the width of the fluid ejection device;

the ribs of the array of ribs, the at least one input channel, and the at least one output channel are aligned with the diagonal arrangements of the respective sets of neighboring nozzles.

16. The fluid ejection device of claim 15, further comprising a number of chamber walls separating adjacent ejection chambers.

17. The fluid ejection device of claim 10, wherein the at least one micropump comprises multiple micropumps, each associated with one of the at least one ejection chambers to align flow rates through the plurality of ejection chambers.

18. A method, comprising:

circulating fluid through a plurality of ejection chambers at a first flow rate by:

supplying fluid to the plurality of ejection chambers at a first pressure; and collecting fluid from the plurality of ejection chambers at a second pressure that is lower than the first pressure; and compensate for pressure non-uniformities across the plurality of ejection chambers by selectively adjusting circulation of fluid through at least one ejection chamber to a second flow rate by actuating at least one micropump fluidically coupled to the at least one ejection chamber.

19. The method of claim 18, wherein circulating fluid through the plurality of ejection chambers at the first flow rate by supplying fluid to the plurality of ejection chambers at the first pressure and collecting fluid from the plurality of ejection chambers at the second pressure comprises:

inputting fluid at the first pressure to a plurality of input channels that are each fluidically coupled to a respective ejection chamber of the plurality of ejection chambers; and outputting fluid at the second pressure from a plurality of output channels that are each fluidically coupled to one of the respective ejection chambers.

20. The method of claim 18, wherein the second pressure is a vacuum pressure.

* * * * *